US011377968B2

(12) United States Patent
Igarashi et al.

(10) Patent No.: US 11,377,968 B2
(45) Date of Patent: Jul. 5, 2022

(54) TURBINE WHEEL

(71) Applicant: Mitsubishi Heavy Industries, Ltd., Tokyo (JP)

(72) Inventors: Shota Igarashi, Yokohama (JP); Yasuyuki Watanabe, Yokohama (JP); Tadashi Murakata, Yokohama (JP); Yoshiki Sakamoto, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 17/160,745

(22) Filed: Jan. 28, 2021

(65) Prior Publication Data

US 2021/0246801 A1 Aug. 12, 2021

(30) Foreign Application Priority Data

Feb. 10, 2020 (JP) ..... JP2020-020336

(51) Int. Cl.
*F01D 5/30* (2006.01)
*F01D 5/02* (2006.01)

(52) U.S. Cl.
CPC ..... *F01D 5/3007* (2013.01); *F01D 5/02* (2013.01); *F05D 2220/32* (2013.01); *F05D 2240/24* (2013.01)

(58) Field of Classification Search
CPC . F01D 5/3007; F01D 5/02; F01D 5/30; F01D 5/32; F01D 5/24; F01D 5/25; F05D 2220/32; F05D 2240/24; F05D 2260/30
See application file for complete search history.

(56) References Cited

U.S. PATENT DOCUMENTS 4,890,981 A * 1/1990 Corsmeier ..... F01D 5/3015 416/220 R
6,082,970 A * 7/2000 Tsukamoto ..... F01D 5/24 416/193 A
7,290,988 B2 * 11/2007 Boston ..... F01D 5/3015 416/220 R (Continued)

FOREIGN PATENT DOCUMENTS

JP 2011-21605 A 2/2011

*Primary Examiner* — Courtney D Heinle
*Assistant Examiner* — Ryan C Clark
(74) *Attorney, Agent, or Firm* — Crowell & Moring LLP

(57) ABSTRACT

Each wheel-side tab section of a turbine wheel is formed such that a bottom surface of a second groove are continuous with bottom surfaces of first grooves that are adjacent thereto. The outline shape of each wheel-side tab section when seen in an axial direction is a shape in which a portion of a particular shape is replaced with straight portions along predetermined straight lines. The particular shape includes a predetermined range of an outline shape of an attachment section as seen in the axial direction. The portion is at least on the radially inward side of the bottom surface of the second groove and is on an outer side, in the circumferential direction, of the predetermined straight lines. The predetermined straight lines pass through a central axis and points within a range along the particular shape from intersections with the bottom surface of the second groove to peaks of wheel-side hook portions adjacent, on the radially inward side, to the bottom surface of the second groove.

7 Claims, 10 Drawing Sheets

(56) References Cited

U.S. PATENT DOCUMENTS

| | | | | |
|---|---|---|---|---|
| 8,485,784 | B2 * | 7/2013 | Eastman | F01D 5/326 416/220 R |
| 8,905,717 | B2 * | 12/2014 | Roman-Morales | F01D 5/326 416/220 R |
| 2011/0014053 | A1 | 1/2011 | Eastman et al. | |
| 2017/0241274 | A1 * | 8/2017 | Danyew | F01D 5/3007 |
| 2019/0071984 | A1 * | 3/2019 | Leon | F01D 5/3015 |

* cited by examiner

TURBINE WHEEL

BACKGROUND OF THE INVENTION

1. Field of the Invention

The present invention relates to a turbine wheel of gas turbines.

2. Description of the Related Art

A gas turbine generally includes: a compressor that compresses air to generate compressed air; a combustor that mixes the compressed air from the compressor with fuel and combusts the mixture to generate a combustion gas; and a turbine that obtains shaft power by the combustion gas from the combustor. The turbine includes a turbine rotor that converts the kinetic energy of the combustion gas into rotational power. The turbine rotor is formed by axially stacking disc-like turbine wheels having a plurality of turbine rotor blades that are arrayed over the entire circumference of outer peripheral portions of the turbine wheels.

As one of structures for connecting a turbine wheel and turbine rotor blades, there is one referred to as a dovetail structure. In this connecting structure, blade root sections (dovetails) of turbine rotor blades are axially inserted into slots (mating grooves) provided at an outer peripheral portion of a turbine wheel to be connected to the turbine wheel. The slots of the turbine wheel extend in a direction approximately parallel to a rotor axial direction And are formed into a shape that is complementary to the blade root sections of the turbine rotor blades. In this connecting structure, the turbine rotor blades are fixed to the turbine wheel by the engagement between recesses and projections of the blade root sections of the turbine rotor blades and complementary recesses and projections on the wall surfaces of the slots of the turbine wheel due to the action of the radially outward centrifugal force on the turbine rotor blades along with the rotation of the turbine rotor.

Although the turbine rotor blades are inhibited from moving in the rotor radial direction in this connecting structure, the turbine rotor blades are allowed to move in the rotor axial direction Along the slots of the turbine wheel. In view of this, there is one that uses a fixation wire in order to inhibit the turbine rotor blades from moving in the rotor axis direction (see JP-2011-21605-A, for example).

JP-2011-21605-A discloses that a first lockwire slot (groove) that is closed at its radially outer end and opens at its radially inner end is formed on one axial side of each of a plurality of radially projecting portions defining dovetail slots of a turbine wheel. In addition, second lockwire slots (groove) are defined by lock tabs provided on one side, in the axial direction, of dovetails (blade root sections) of a plurality of turbine rotor blades. When the plurality of first lockwire slots of the turbine wheel and the second lockwire slots of the plurality of turbine rotor blades align with each other, an annular retention slot is formed to extend over the entire circumference of an outer peripheral portion of the turbine wheel. Arranging a lockwire (fixation wire) in the annular retention slot inhibits the turbine rotor blades from moving along the dovetail slots.

Meanwhile, since a gas turbine obtains shaft power for a turbine rotor from a high-temperature and high-pressure combustion gas, it is necessary to cool each part of the turbine rotor such as turbine wheels or turbine rotor blades by cooling air, and to suppress a temperature increase in each part. In the gas turbine, generally, compressed air bled from a compressor is used as the cooling air. In this case, increasing the flow rate of the cooling air means increasing the flow rate of the compressed air bled from the compressor. Accordingly, if the flow rate of the cooling air is increased, the flow rate of the combustion gas to drive the turbine rotor decreases by a corresponding amount, and thus the overall efficiency of the gas turbine deteriorates.

One of the effective means for attaining high efficiency of a gas turbine is to reduce cooling air for cooling each part of a turbine rotor. In this case, the ambient temperature in a wheel space formed in front and rear of a turbine wheel in the rotor axis direction increases. In view of this, it has been proposed to change the material of a turbine wheel to a Ni based alloy that is more heat-resistant than conventionally used 12 Cr steels. It should be noted however that there is a concern over occurrences of cracks resulting from residual tensile stresses if parts formed of a Ni based alloy material are used in a high-temperature environment in a state in which they are receiving the residual tensile stresses.

In the technique described in JP-2011-21605-A, both sides, in the circumferential direction, of the dovetails (blade root sections) of the turbine rotor blades are processed into concave-convex shapes, and thereby concave-convex portions are also formed on both sides, in the circumferential direction, of the lock tabs of the turbine rotor blades. In addition, both sides, in the circumferential direction, of the radially projecting portions defining the dovetail slots are processed into concave-convex shapes, and thereby concave-convex portions are also formed on both sides, in the circumferential direction, of protruding portions (lock tabs) that are provided on one axial side of the radially projecting portions and defines the first lockwire slots of the turbine wheel. Accordingly, the circumferentially concave-convex portions of the lock tabs of the turbine wheel and the circumferentially concave-convex portions of the lock tabs of the turbine rotor blades have shapes that are complementary to each other, and engage with each other.

In such a configuration, at the time of assembly or disassembly of the turbine rotor blades onto or from the turbine wheel, part of the turbine rotor blades come into contact with the circumferentially protruding portions of the lock tabs of the turbine wheel in some cases. This may cause residual tensile stresses at base portions of the lock tabs. Accordingly, when a Ni based alloy is applied to the turbine wheel with a configuration like the one described in JP-2011-21605-A, there is a concern over occurrences of cracks in the turbine wheel resulting from residual tensile stresses caused by the interference of the turbine rotor blades with the lock tabs of the turbine wheel at the time of assembly or disassembly of the turbine rotor blades.

In addition, the lockwire (fixation wire) is retained in the annular retention slot formed by the first lockwire slots of the turbine wheel and the second lockwire slots of the turbine rotor blades. The lockwire is pressed against the bottom of the annular retention slot due to the action of the centrifugal force when the turbine rotor is rotated at high speed. In order to ensure the durability of the lockwire, it is necessary to suppress local occurrences of excessive stresses on the lockwire when the lockwire is retained in the first and second lockwire slots.

The present invention has been made in order to overcome the problems described above, and an object of the present invention is to provide a turbine wheel that can suppress occurrences of residual tensile stresses due to contact with turbine rotor blades at the time of assembly or disassembly while suppressing local occurrences of excessive stresses on a fixation wire at the time of the rotation of a turbine rotor.

SUMMARY OF THE INVENTION

The present application includes a plurality of means for overcoming the problems described above, and one example thereof is a turbine wheel that is rotatable around a central axis, and is connectable, at an outer peripheral portion, with a plurality of turbine rotor blades each including a blade root section and a blade-side tab section, the blade root section having a plurality of tiers of concave-convex blade-side neck portions and blade-side hook portions in a radial direction, the plurality of tiers of blade-side neck portions and blade-side hook portions being formed on both sides of the blade root section in a circumferential direction, the blade-side tab section being provided on one side of the blade root section in an axial direction and forming a first groove opened toward both sides in the circumferential direction and toward a radially inward side. The turbine wheel includes: a plurality of attachment sections that are arranged at the outer peripheral portion at intervals in the circumferential direction, and form a plurality of slots into which the blade root sections are inserted in the axial direction to engage with the plurality of slots; and a plurality of wheel-side tab sections provided on one side of the plurality of attachment sections in the axial direction, each of the plurality of wheel-side tab sections forming a second groove opened toward both sides in the circumferential direction and toward the radially inward side. Each of the plurality of attachment sections has a plurality of tiers of wheel-side hook portions and a plurality of tiers of wheel-side neck portions on both sides of the attachment section in the circumferential direction, the plurality of tiers of wheel-side hook portions and the plurality of tiers of wheel-side neck portions being formed to respectively engage with the blade-side neck portions and the blade-side hook portions of the blade root section. The plurality of wheel-side tab sections are formed such that, together with the blade-side tab sections of the plurality of turbine rotor blades, the plurality of wheel-side tab sections form a wire groove for retaining an annular fixation wire to inhibit the plurality of turbine rotor blades from moving along the slots. Each of the plurality of wheel-side tab sections is formed such that a bottom surface of the second groove is continuous with bottom surfaces of first grooves that are adjacent on both sides in the circumferential direction. An outline shape of each wheel-side tab section when seen in the axial direction is formed such that the outline shape matches a shape in which a portion of a particular shape is replaced with straight portions along predetermined straight lines. The particular shape is part of an outline shape of each attachment section when seen in the axial direction, and includes an range from a radially outer end, toward the radially inward side, to at least a wheel-side hook portion adjacent, on the radially inward side, to the bottom surface of the second groove. The portion being at least on the radially inward side of the bottom surface of the second groove and being on an outer side, in the circumferential direction, of the predetermined straight lines. Each of the predetermined straight lines passes through the central axis and a point in a range along the particular shape from an intersection with the bottom surface of the second groove to a peak of wheel-side hook portion adjacent, on the radially inward side, to the bottom surface of the second groove.

According to the present invention, an annular fixation wire is pressed almost uniformly against continuous bottom surfaces of first grooves and the second grooves due to the action of the centrifugal force at the time of the rotation of a turbine rotor. Accordingly, it is possible to prevent local occurrences of excessive stresses on the fixation wire. In addition, the outline shape of the wheel-side tab section when seen in the axial direction is such that at least part of projecting portions are removed from a wheel-side tab section of a conventional turbine wheel. Accordingly, it is possible to inhibit the wheel-side tab section from getting caught by a blade root section or a blade-side tab section of a turbine rotor blade when the turbine rotor blade is assembled onto or disassembled from the turbine wheel. Accordingly, occurrences of residual tensile stresses on the turbine wheel due to contact between turbine rotor blades and the wheel-side tab sections can be suppressed.

Problems, configurations and advantages other than those described above become apparent from the following explanation of embodiments.

DESCRIPTION OF THE PREFERRED EMBODIMENTS

Hereinafter, embodiments of a turbine wheel of the present invention are explained by using the drawings. The present invention is applied to a turbine wheel of axial turbines.

First Embodiment

Figure 1:
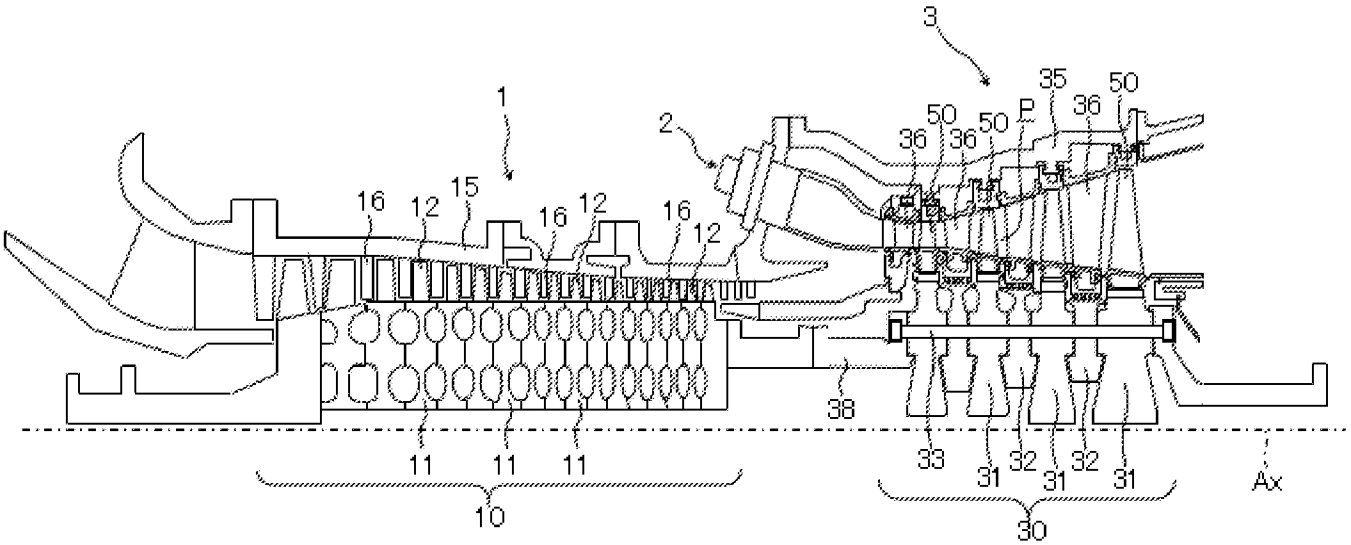
FIG. 1 is a longitudinal cross-sectional view illustrating a gas turbine including a turbine wheel according to a first embodiment of the present invention, in a state that a lower half section of the gas turbine is omitted.

First, the configuration of a gas turbine including a turbine wheel according to a first embodiment of the present invention is explained by using FIG. 1. FIG. 1 is a longitudinal cross-sectional view illustrating the gas turbine including the turbine wheel according to the first embodiment of the present invention, in a state in which a lower half section of the gas turbine is omitted.

In FIG. 1, the gas turbine includes: a compressor 1 that compresses air that has been taken in, and generates compressed air; a combustor 2 that mixes the compressed air generated by the compressor 1 with fuel from a fuel system (not illustrated), and combusts the mixture to generate a combustion gas; and a turbine 3 that is rotation-driven by the high-temperature and high-pressure combustion gas generated at the combustor 2. The gas turbine has a multi-can type combustor, for example, and in the multi-can type, a plurality of combustors 2 are arrayed annularly at intervals in the circumferential direction. The turbine 3 drives the compressor 1 and drives a load (a driven device such as a generator, a pump, and a process compressor) which is not illustrated. The compressor 1 and the turbine 3 of the gas turbine rotates around a central axis Ax. The turbine 3 is supplied with the compressed air bled from the compressor 1 as cooling air to cool components of the turbine 3.

The compressor 1 includes a compressor rotor 10 that is rotation-driven by the turbine 3 and a compressor casing 15 that houses the compressor rotor 10 such that compressor rotor 10 can rotate therein. The compressor 1 is an axial compressor, for example. The compressor rotor 10 includes a plurality of disc-like compressor wheels 11 that are stacked axially and a plurality of compressor rotor blades 12 that are coupled to an outer peripheral portion of each compressor wheel 11. In the compressor rotor 10, the plurality of compressor rotor blades 12 annularly arrayed at the outer peripheral portion of each compressor wheel 11 form one compressor rotor blade row.

On the downstream side of each compressor rotor blade row in the direction of the flow of a working fluid, a plurality of compressor stator blades 16 are arrayed annularly. The annularly arrayed compressor stator blades 16 form one compressor stator blade row. The compressor stator blade rows are fixed inside the compressor casing 15. In the compressor 1, each compressor rotor blade row and a compressor stator blade row located immediately downstream of the compressor rotor blade row form one stage.

The turbine 3 includes a turbine rotor 30 that is rotation-driven by the combustion gas from the combustor 2 and a turbine casing 35 that houses the turbine rotor 30 such that the turbine rotor 30 can rotate therein. A flow passage P through which the combustion gas flows is formed between the turbine rotor 30 and the turbine casing 35. The turbine 3 is an axial turbine.

The turbine rotor 30 is formed by integrally fixing, by stacking bolts 33, a plurality of disc-like turbine wheel assemblies 31 that are axially arrayed and spacers 32 that are arranged between the plurality of turbine wheel assemblies 31. Each turbine wheel assembly 31 has a plurality of annularly arrayed turbine rotor blades 50 at its outer peripheral portion. The annularly arrayed turbine rotor blades 50 form one turbine rotor blade row. Each turbine rotor blade row is arranged in the flow passage P.

A plurality of turbine stator blades 36 are arrayed annularly on the upstream side, with respect to the flow of the working fluid, of each turbine rotor blade row. The annularly arrayed turbine stator blades 36 form one turbine stator blade row. The turbine stator blade rows are fixed to the inside of the turbine casing 35 such that the turbine stator blade rows are arranged in the flow passage P. In the turbine 3, each turbine stator blade row and a turbine rotor blade row located immediately downstream of the turbine stator blade row form one stage.

The turbine rotor 30 is connected to the compressor rotor 10 via an intermediate shaft 38. The turbine casing 35 is connected to the compressor casing 15.

Figure 2:
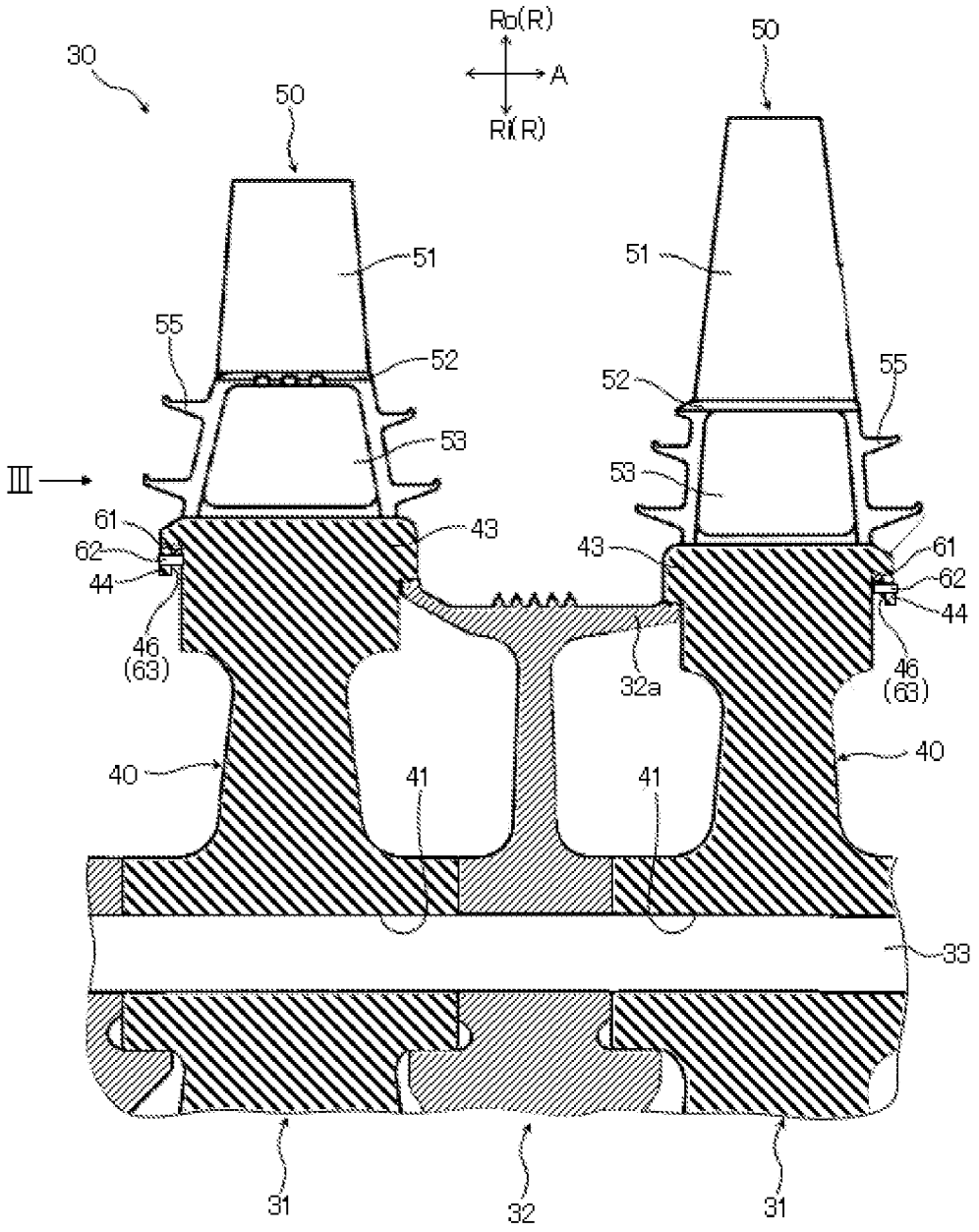
FIG. 2 is an enlarged cross-sectional view illustrating a portion of the turbine rotor including the turbine wheel according to the first embodiment of the present invention illustrated in FIG. 1.
Figure 3:
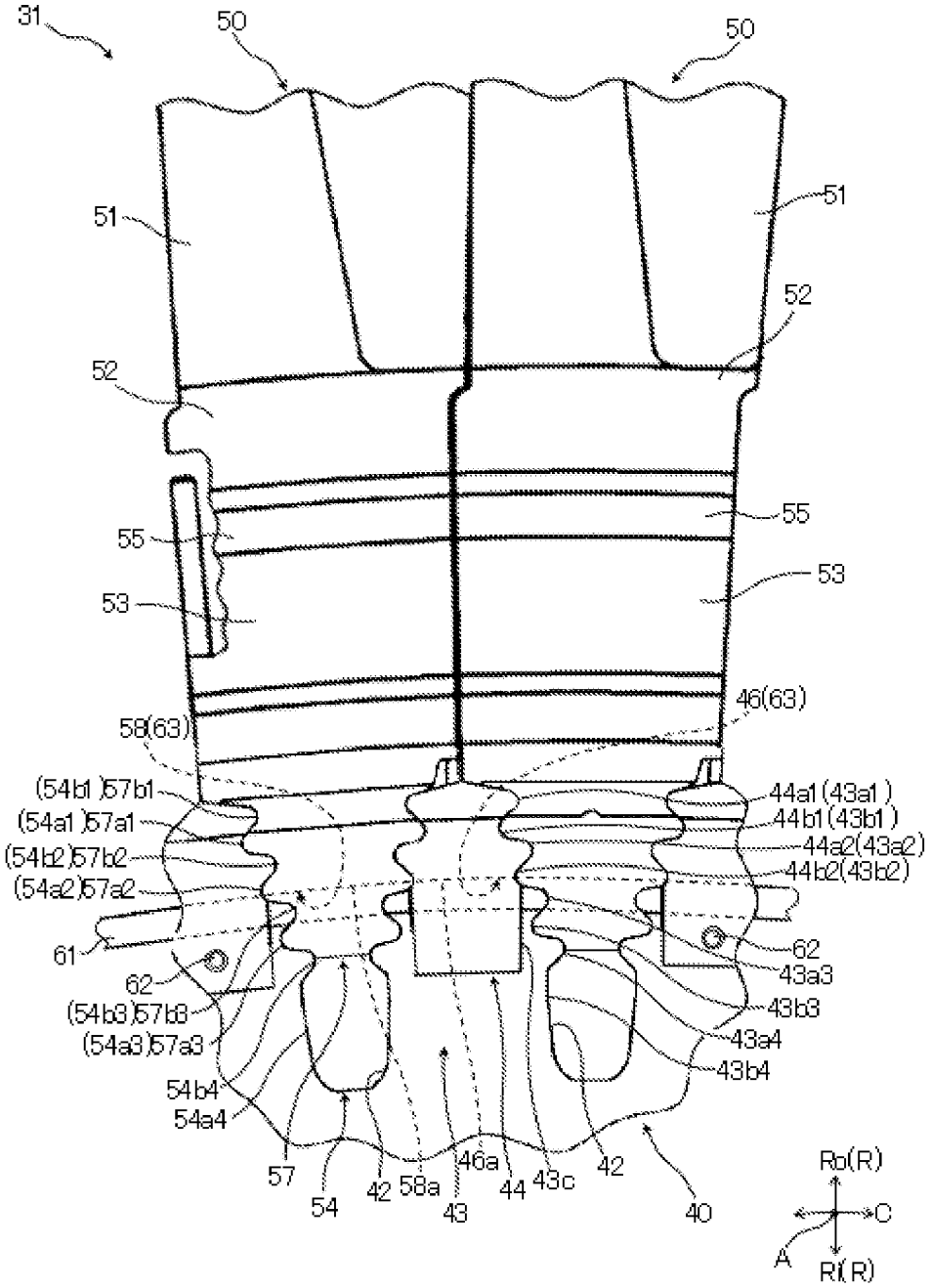
FIG. 3 is a figure of a connecting structure of turbine rotor blades and the turbine wheel according to the first embodiment of the present invention illustrated in FIG. 2, as seen in the direction of an arrow III.

Next, the configuration of the turbine rotor including the turbine wheel according to the first embodiment of the present invention is explained by using FIGS. 2 and 3. FIG. 2 is an enlarged cross-sectional view illustrating a portion of the turbine rotor including the turbine wheel according to the first embodiment of the present invention illustrated in FIG. 1. FIG. 3 is a figure of a connecting structure of the turbine rotor blades and the turbine wheel according to the first embodiment of the present invention illustrated in FIG. 2, as seen in the direction of an arrow III.

As illustrated in FIG. 2 and FIG. 3, each turbine wheel assembly 31 of the turbine rotor 30 includes a disc-like turbine wheel 40 and the plurality of turbine rotor blades 50 that are connected to an outer peripheral portion of the turbine wheel 40 in a state in which the turbine rotor blades 50 are arrayed in the circumferential direction. The plurality of turbine rotor blades 50 connected to the turbine wheel 40 are inhibited from moving relative to the turbine wheel 40 by a fixation wire 61. The fixation wire 61 is retained at the outer peripheral portion of the turbine wheel 40 in a state where one end side and the other end side of the fixation wire 61 overlap each other to form an annular shape. The fixation wire 61 is inhibited from falling off from the outer peripheral portion of the turbine wheel 40 by a plurality of retention pins 62. Adjacent turbine wheels 40 are linked via a spacer 32 as illustrated in FIG. 2. The spacer 32 has, at its outer peripheral portion, arm portions 32*a* that extend toward adjacent turbine wheels 40. The arm portions 32*a* of the spacer 32 function as sealing portions to seal the gaps between the adjacent turbine wheels 40.

Figure 4:
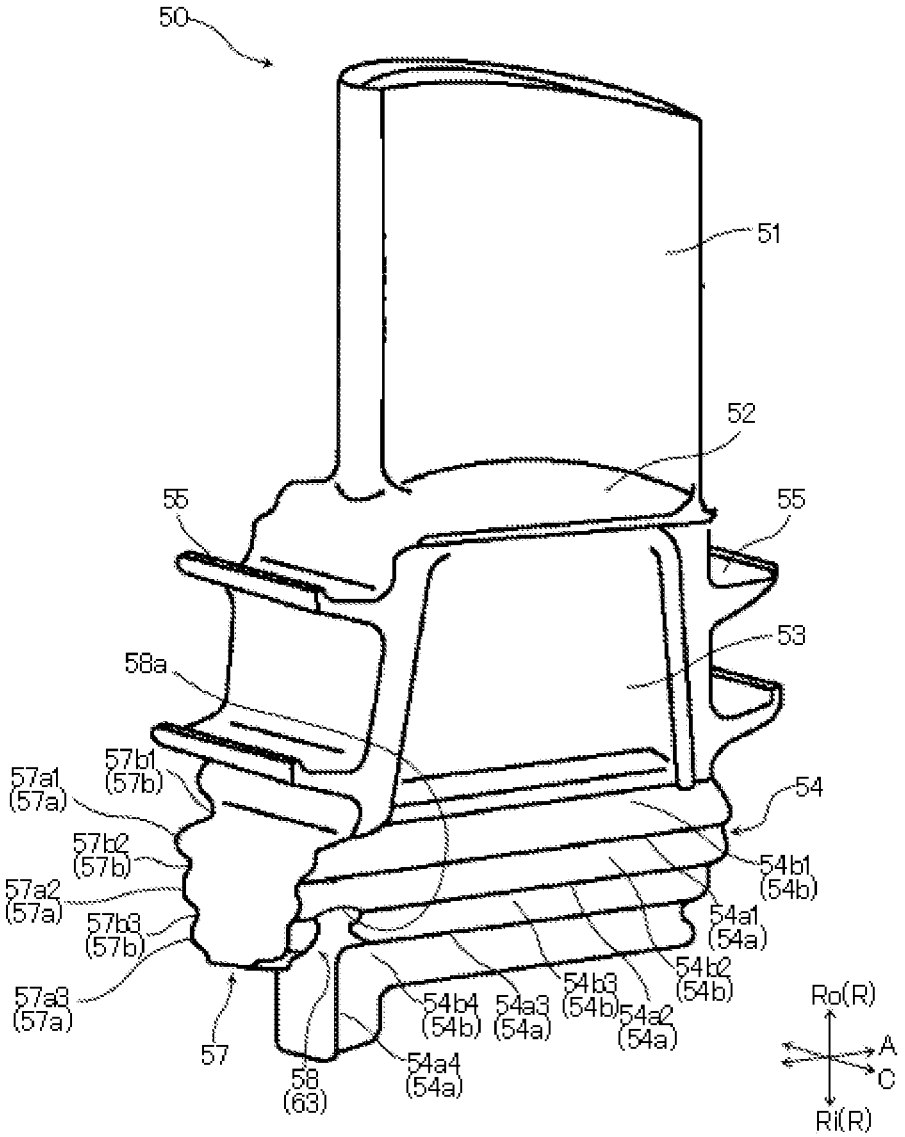
FIG. 4 is a perspective view illustrating a turbine rotor blade connectable to the turbine wheel according to the first embodiment of the present invention.

Next, the structures of turbine rotor blades to be connected to the turbine wheel according to the first embodiment of the present invention are explained by using FIGS. 2 to 4. FIG. 4 is a perspective view illustrating a turbine rotor blade connectable to the turbine wheel according to the first embodiment of the present invention.

In FIGS. 2 to 4, a turbine rotor blade 50 has a blade section 51, a platform section 52, a shank section 53, and a blade root section 54 that are formed integrally. The blade section 51 has an airfoil shape extending in the radial direction R of the turbine rotor 30. The platform section 52 is provided at an end portion of the blade section 51 on a radially inward side Ri. The shank section 53 extends from the platform section 52 in the direction opposite to the blade section 51. The blade root section 54 is provided at an end portion of the shank section 53 on the radially inward side Ri. That is, the turbine rotor blade 50 has a configuration in which the blade section 51, the platform section 52, the shank section 53, and the blade root section 54 are formed in this order toward the radially inward side Ri.

The blade section 51 is a part to be arranged in the flow passage P (see FIG. 1) for combustion gas. The platform section 52 defines part of the inner circumferential surface of the flow passage P for combustion gas. The shank section 53 is provided with a plurality of seal fins 55 (four seal fins in FIGS. 2 and 4) that suppress the intrusion of the combustion gas, for example. The seal fins 55 extend in the axial direction A from the shank section 53, for example, and are bent at their tip portions toward the radially outward side Ro.

As illustrated in FIGS. 3 and 4, the blade root section 54 is a portion to be coupled with the turbine wheel 40 and has an attachment structure tapered radially inward (e.g. an attachment structure referred to as an upside-down Christmas tree type structure). Specifically, the blade root section 54 has, on both sides in the circumferential direction C, projecting blade-root-side hook sections 54*a* that extend in a direction approximately parallel to the axis direction A. A plurality of tiers of the projecting blade-root-side hook sections 54*a* are provided in the radial direction R. Between the plurality of tiers of blade-root-side hook portions 54*a*, blade-root-side neck portions 54*b* are formed to be recessed in the circumferential direction C relative to the blade-root-side hook portions 54*a*.

For example, the blade root section 54 has first to fourth blade-root-side hook portions 54*a*1, 54*a*2, 54*a*3, and 54*a*4 in this order toward the radially inward side Ri. Corresponding to the first to fourth blade-root-side hook portions 54*a*1, 54*a*2, 54*a*3, and 54*a*4, the blade root section 54 has first to fourth blade-root-side neck portions 54*b*1, 54*b*2, 54*b*3, and 54*b*4 in this order toward the radially inward side Ri. The plurality of tiers of blade-root-side hook portions are formed such that, when the blade root section 54 is seen in the axial direction A, the distance between circumferential positions of a pair of peaks on both sides of each tier is gradually shorter in the order of the first blade-root-side hook portions 54*a*1, the second blade-root-side hook portions 54*a*2, the third stage blade-root-side hook portions 54*a*3, and the fourth blade-root-side hook portions 54*a*4.

A blade-side tab section 57 is integrally provided on one side (the left side in FIG. 4) of the blade root section 54 in the axial direction A. The blade-side tab section 57 protrudes from an end portion of the blade root section 54 on the side of the shank section 53 (the radially outward side Ro) toward the radially inward side Ri. Together with the blade root section 54, the blade-side tab section 57 forms a first groove 58 opened toward both sides in the circumferential direction C and toward the radially inward side Ri. That is, the first groove 58 has a bottom surface 58*a* formed on the radially outward side Ro. Together with a second groove 46 mentioned later of the turbine wheel 40, the first groove 58 forms a wire groove 63 for retaining the fixation wire 61. The fixation wire 61 can be inserted into the first groove 58 from the inner side in the radial direction R. For example, the first groove 58 is formed such that the radial position of the bottom surface 58*a* is positioned near the peaks of the second blade-root-side hook portions 54*a*2.

In addition, the outline shape of the blade-side tab section 57 on both sides in the circumferential direction C when seen in the axial direction A is a serrated shape similar to the shape of the blade root section 54. That is, the outline shape of the blade-side tab section 57 when seen in the axial direction A is formed such that the outline shape almost matches (is an approximately identical shape to) a shape that is part of the outline shape of the blade root section 54 when seen in the axial direction A and that includes a range from the outer end of the outline shape in the radial direction R (an end portion on the side of the shank section 53) to an intermediate portion. Specifically, the blade-side tab section 57 has, in the radial direction R, a plurality of tiers of the projecting blade-tab-side hook portions 57*a* on both sides in the circumferential direction C. Between the plurality of tiers of blade-tab-side hook portions 57*a*, a plurality of blade-tab-side neck portions 57*b* are formed to be recessed in the circumferential direction C relative to the blade-tab-side hook portions 57*a*. In other words, the blade-side tab section 57 is equivalent to a portion where a predetermined area of the blade root section 54 that has been processed to have the hook portions 54*a* and the neck portions 54*b* is extended in the axial direction A.

For example, the blade-side tab section 57 has first to third blade-tab-side hook portions 57*a*1, 57*a*2, and 57*a*3 in this order toward the radially inward side Ri. Corresponding to the first to third blade-tab-side hook portions 57*a*1, 57*a*2, and 57*a*3, the blade-side tab section 57 has first to third blade-tab-side neck portions 57*b*1, 57*b*2, and 57*b*3 in this order toward the radially inward side Ri. Similarly to the peaks on both sides of the plurality of tiers of blade-root-side hook portions 54*a*, the plurality of tiers of blade-tab-side hook portions 57*a* are formed such that, when the blade-side tab section 57 is seen in the axial direction A, the distance between the circumferential positions of a pair of peaks on both sides of each tier is gradually shorter in the order of the first blade-tab-side hook portions 57*a*1, the second blade-tab-side hook portions 57*a*2, and the third blade-tab-side hook portions 57*a*3. That is, the outline shape of the blade-side tab section 57 when seen in the axial direction A is formed such that the outline shape almost matches a shape that is part of the outline shape of the blade root section 54 when seen in the axial direction A and that includes a range from the outer end of the outline shape in the radial direction R (the end portion closer to the shank section 53), toward the radially inward side Ri, to the third blade-root-side hook portion 54*a*3.

Figure 5:
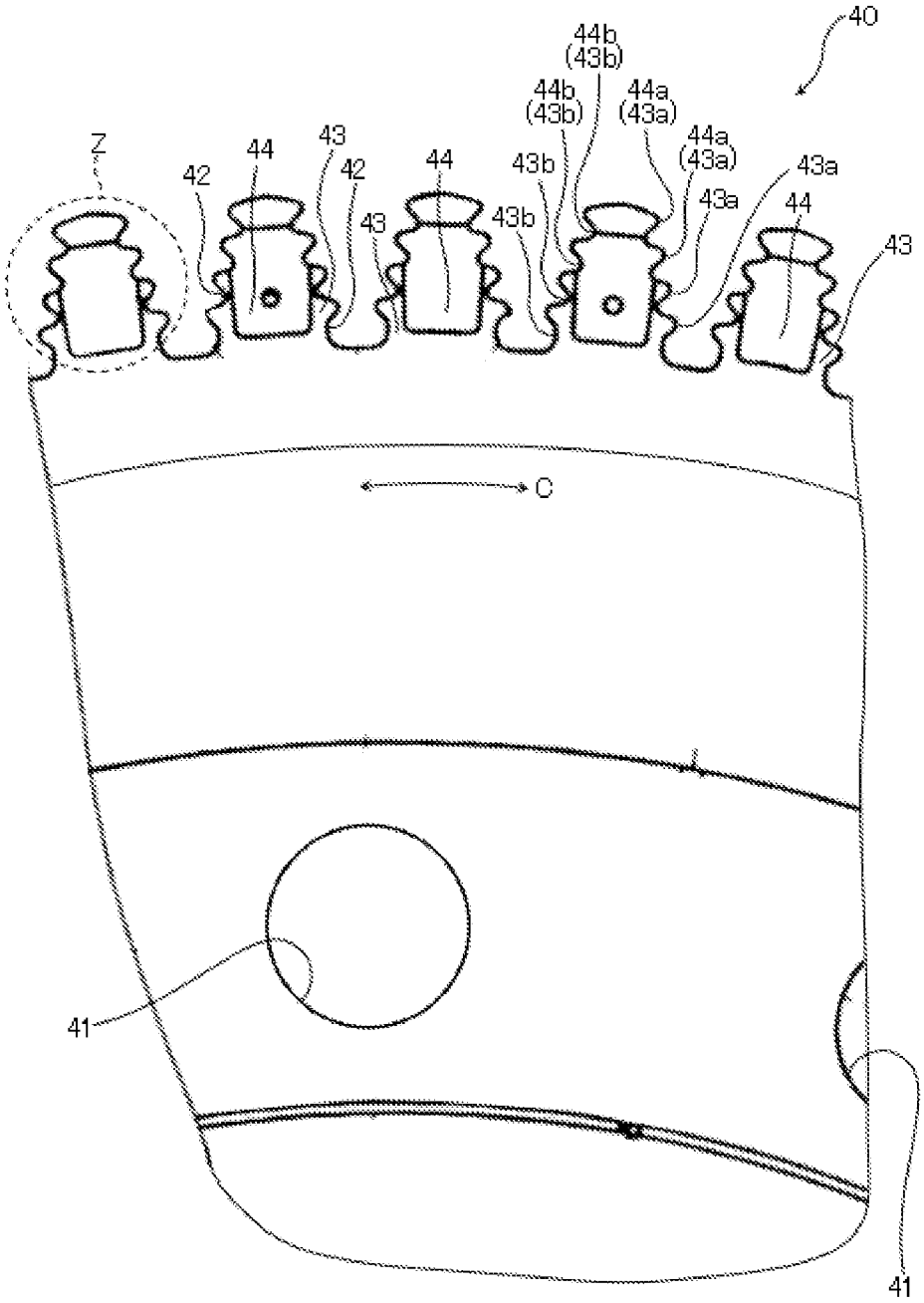
FIG. 5 is a front view illustrating a portion of the turbine wheel according to the first embodiment of the present invention.
Figure 6:
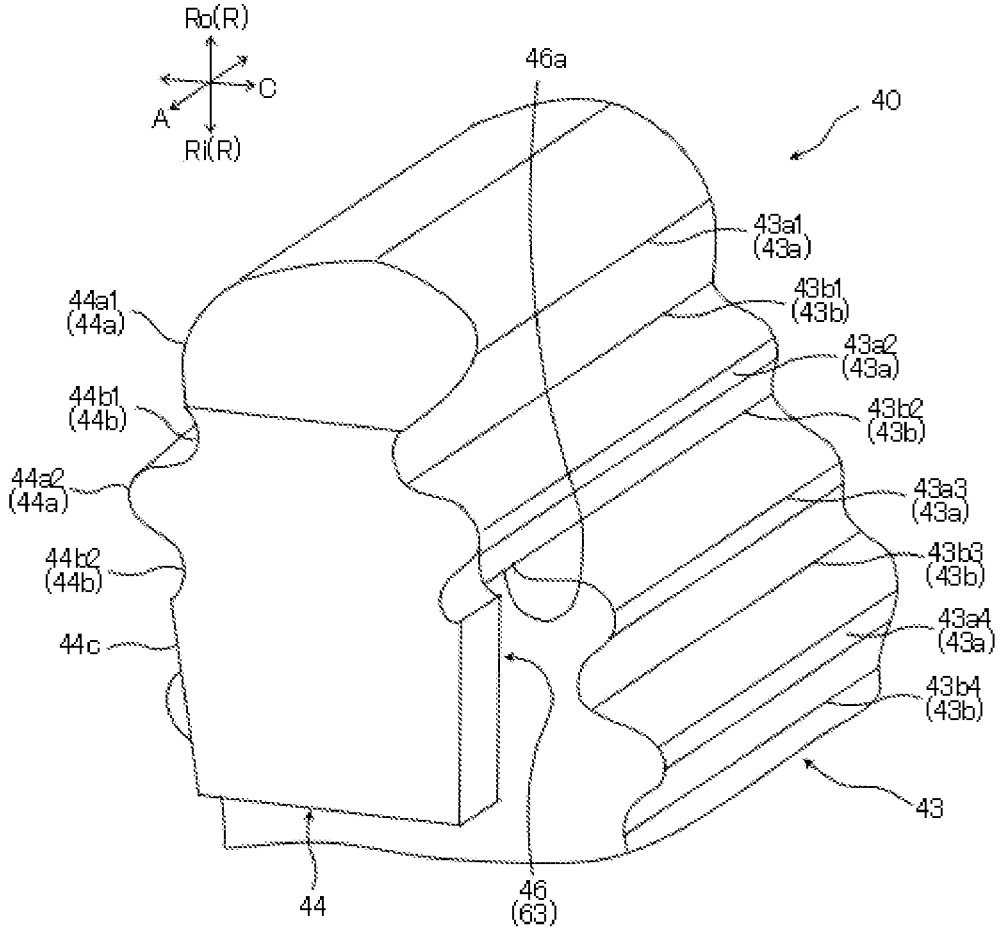
FIG. 6 is a perspective view illustrating an attachment section and a wheel-side tab section of the turbine wheel according to the first embodiment of the present invention indicated by a reference character Z in FIG. 5.
Figure 7:
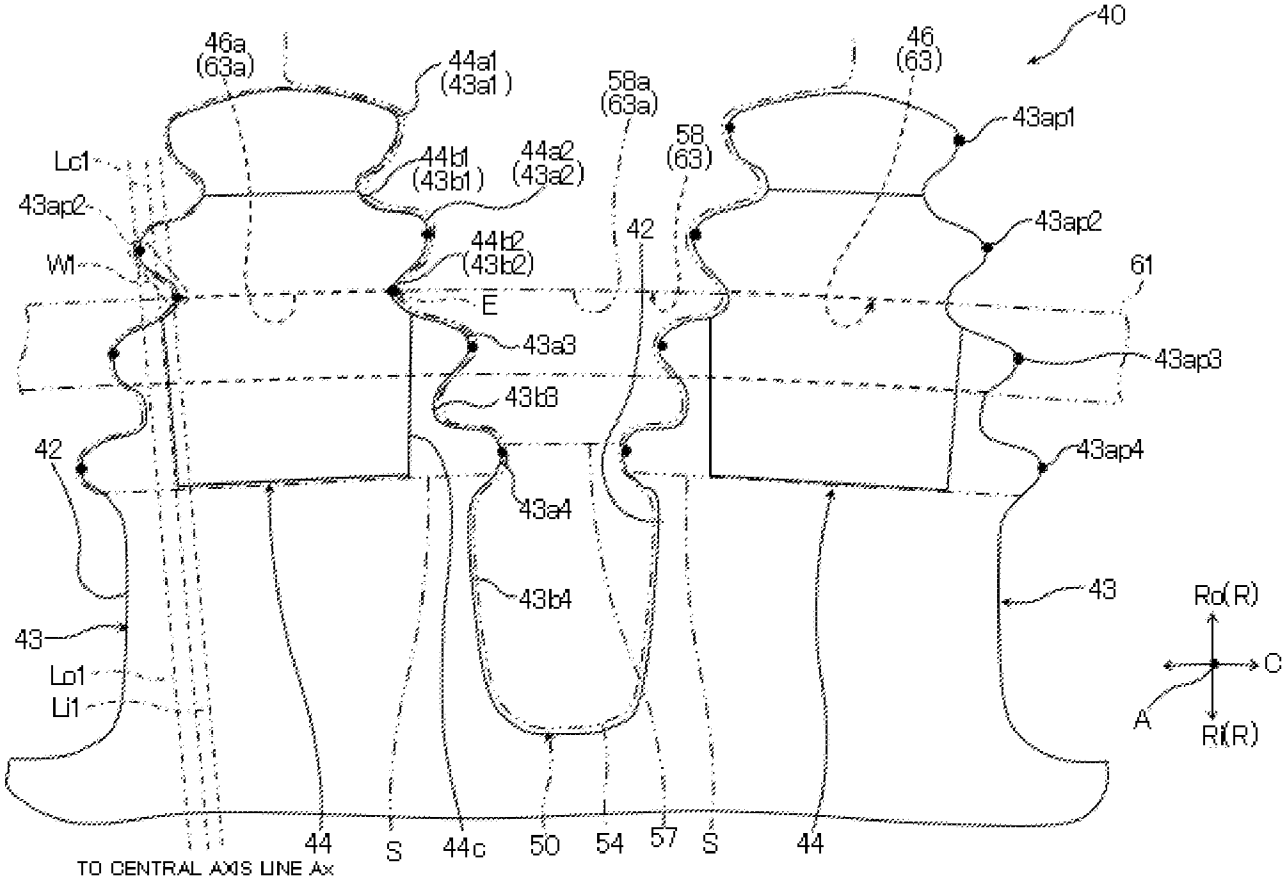
FIG. 7 is an explanatory diagram illustrating the outline shapes of attachment sections and wheel-side tab sections of the turbine wheel in the first embodiment of the present invention when seen in an axial direction.

Next, the structure of the turbine wheel according to the first embodiment of the present invention is explained by using FIGS. 2, 3, and 5 to 7. FIG. 5 is a front view illustrating a portion of the turbine wheel according to the first embodiment of the present invention. FIG. 6 is a perspective view illustrating an attachment section and a wheel-side tab section of the turbine wheel according to the first embodiment of the present invention indicated by a reference character Z in FIG. 5. FIG. 7 is an explanatory diagram illustrating the outline shapes of attachment sections and wheel-side tab sections of the turbine wheel in the first embodiment of the present invention when seen in the axis direction.

The turbine wheel 40 is formed by using a Ni based alloy as a base material. As illustrated in FIGS. 2 and 5, an annular thicker portion at an intermediate section of the wheel body 45 in the radial direction R has multiple bolt holes 61 that penetrate the thicker portion in the axial direction A. The bolt holes 61 are provided at predetermined intervals in the circumferential direction C. A stacking bolt 33 is inserted through each bolt hole 41.

As illustrated in FIGS. 3 and 5, a plurality of slots 42 are formed in an outer peripheral portion of the turbine wheel 40 at predetermined intervals in the circumferential direction C. The slots 42 are grooves that extend from one side surface, in the axial direction A (the direction orthogonal to the sheets of FIGS. 3 and 5), of the turbine wheel 40 to the other side surface and are opened toward both sides in the axial direction A and toward the radially outward side Ro. The slots 42 are formed to be complementary to the shapes of blade root sections 54 of turbine rotor blades 50, and are portions into which the blade root sections 54 of the turbine rotor blades 50 are inserted in the axial direction A to be fit.

In other words, the plurality of slots 42 are formed by arranging a plurality of attachment sections 43, which protrude toward the radially outward side Ro, at predetermined intervals in the circumferential direction at the outer peripheral portion of the turbine wheel 40. Adjacent attachment sections 43 are formed so as to engage with blade root section 54 of turbine rotor blade 50. That is, corresponding to the blade root section 54 that has the attachment structure tapered toward the radially inward side Ri, each attachment section 43 has a structure tapered toward the radially outward side Ro.

Specifically, as illustrated in FIGS. 5 and 6, an attachment section 43 has, on both sides in the circumferential direction C, projecting attachment-section-side hook portions 43*a* that extend in a direction approximately parallel to the axis direction A. A plurality of tiers of the attachment-section-side hook portions 43*a* are provided in the radial direction R. Between the plurality of tiers of attachment-section-side hook portions 43*a*, a plurality of tiers of attachment-section-side neck portions 43*b* are formed to be recessed in the circumferential direction C relative to the attachment-section-side hook portions 43*a*.

For example as illustrated in FIGS. 6 and 7, the attachment section 43 has first to fourth attachment-section-side hook portions 43*a*1, 43*a*2, 43*a*3, and 43*a*4 in this order toward the radially inward side Ri. Corresponding to the first to fourth attachment-section-side hook portions 43*a*1, 43*a*2, 43*a*3 and 43*a*4, the attachment section 43 has first to fourth attachment-section-side neck portions 43*b*1, 43*b*2, 43*b*3, and 43*b*4 in this order toward the radially inward side Ri. the plurality of tiers of attachment-section-side hook portions 43*a*1, 43*a*2, 43*a*3, and 43*a*4 are formed such that, when the attachment section 43 is seen in the axial direction A, the distance between circumferential positions of a pair of peaks 43*ap*1, 43*ap*2, 43*ap*3, and 43*ap*4 on both sides of each tier is gradually longer in the order of the first attachment-section-side hook portions 43*a*1, the second attachment-section-side hook portions 43*a*2, the third attachment-section-side hook portions 43*a*3, and the fourth attachment-section-side hook portions 43*a*4.

As illustrated in FIG. 3, the first to fourth attachment-section-side hook portions 43*a*1, 43*a*2, 43*a*3, and 43*a*4 of the attachment section 43 respectively engage with first to fourth blade-root-side neck portions 54*b*1, 54*b*2, 54*b*3, and 54*b*4 of the blade root section 54 of the turbine rotor blade 50. On the other hand, the first to fourth attachment-section-side neck portions 43*b*1, 43*b*2, 43*b*3, and 43*b*4 of the attachment section 43 respectively engage with first to fourth blade-root-side hook portions 54*a*1, 54*a*2, 54*a*3 and 54*a*4 of the blade root section 54.

As illustrated in FIGS. 2 and 6, a wheel-side tab section 44 is provided on one side of each attachment section 43 in the axial direction A. The wheel-side tab section 44 protrudes from an end portion of each attachment section 43 on the radially outward side Ro toward the radially inward side Ri. Together with the attachment section 43, the wheel-side tab section 44 forms a second groove 46 opened toward both sides in the circumferential direction C and toward the radially inward side Ri. That is, the second groove 46 has a bottom surface 46*a* formed on the radially outward side Ro. As illustrated in FIGS. 6 and 7, for example, the wheel-side tab section 44 is formed such that the bottom surface 46*a* of the second groove 46 is positioned near vertices of the second attachment-section-side neck portions 43*b*2 that are on the radially inward side Ri of peaks 43*ap*2 of the second attachment-section-side hook portions 43*a*2, and that are on the radially outward side Ro of peaks 43*ap*3 of the third attachment-section-side hook portions 43*a*3.

As illustrated in FIGS. 3 and 7, together with first grooves 58 of turbine rotor blades 50, second grooves 46 form the wire groove 63 for retaining the fixation wire 61. The fixation wire 61 can be inserted into the second grooves 46 from the inner side in the radial direction R. That is, as illustrated in FIG. 3, in a state in which blade root sections 54 of turbine rotor blades 50 are fit into slots 42 of the turbine wheel 40, the plurality of wheel-side tab sections 44 of the turbine wheel 40 and the plurality of blade-side tab sections 57 of the turbine rotor blades 50 engage with each other alternately. Thereby, the plurality of second grooves 46 of the turbine wheel 40 and the plurality of first grooves 58 of the turbine rotor blades 50 are continuous with each other alternately to form the annular wire groove 63.

The wire groove 63 is an annular space opened toward the radially inward side Ri, and can retain the entire annular fixation wire 61 inserted from the inner side in the radial direction R. The fixation wire 61 retained in the wire groove 63 inhibits the turbine rotor blades 50 from moving along the slots 42 of the turbine wheel 40.

Figure 8:
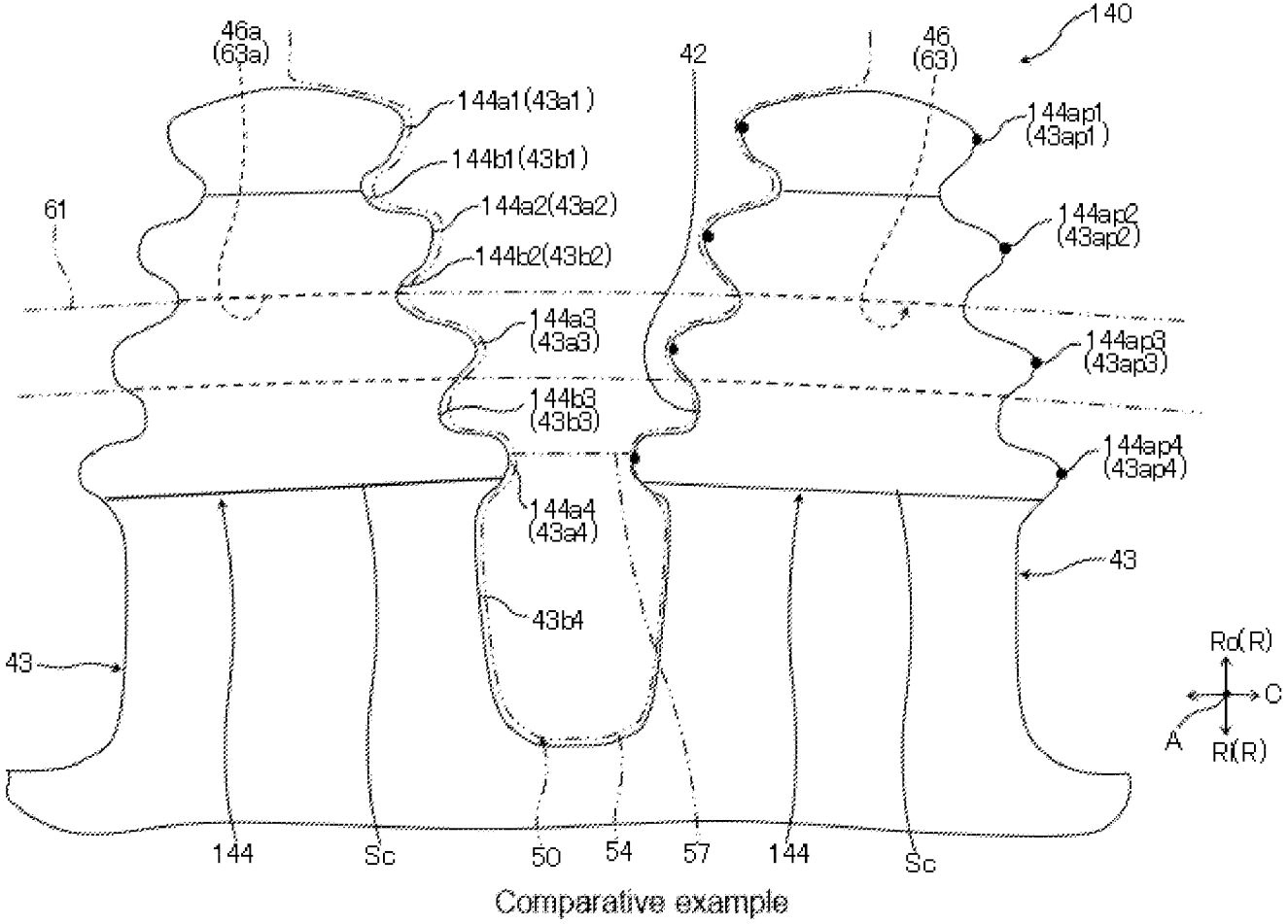
FIG. 8 is an explanatory diagram illustrating the outline shapes of attachment sections and wheel-side tab sections of a turbine wheel of a comparative example when seen in an axial direction.

Next, the shape of wheel-side tabs which is a feature portion of the turbine wheel according to the first embodiment of the present invention is explained by using FIGS. 5 to 8, in comparison with a comparative example. FIG. 8 is an explanatory diagram illustrating the outline shapes of attachment sections and wheel-side tab sections in the turbine wheel of the comparative example when seen in the axial direction.

First, the shapes of attachment sections and wheel-side tab sections of the turbine wheel of the comparative example are explained. Attachment sections of a turbine wheel 140 of a comparative example illustrated in FIG. 8 have the same structures as those of the attachment sections 43 of the turbine wheel 40 according to the present embodiment illustrated in FIG. 6.

That is, an attachment section 43 of the turbine wheel 140 of the comparative example has first to fourth attachment-section-side hook portions 43*a*1, 43*a*2, 43*a*3, and 43*a*4 in this order toward the radially inward side Ri, for example. The attachment section 43 has first to fourth attachment-section-side neck portions 43*b*1, 43*b*2, 43*b*3, and 43*b*4 in this order toward the radially inward side Ri corresponding to the first to fourth attachment-section-side hook portions 43*a*1, 43*a*2, 43*a*3 and 43*a*4. The plurality of tiers of attachment-section-side hook portions 43*a*1, 43*a*2, 43*a*3, and 43*a*4 are formed such that, when the attachment section 43 is seen in the axial direction A, the distance between the circumferential positions of a pair of peaks 43*ap*1, 43*ap*2, 43*ap*3, and 43*ap*4 on both sides of each tier is gradually longer in the order of the first attachment-section-side hook portions 43*a*1, the second attachment-section-side hook portions 43*a*2, the third attachment-section-side hook portions 43*a*3, and the fourth attachment-section-side hook portions 43*a*4.

A wheel-side tab section 144 of the turbine wheel 140 of the comparative example has, when seen in the axial direction A, an outline shape on both sides in the circumferential direction C which is a concave-convex shape similar to that of the attachment section 43. That is, the outline shape of the wheel-side tab section 144 when seen in the axial direction A is formed such that the outline shape almost matches a shape that is part of the outline shape of the attachment section 43 when seen in the axial direction A and that includes a range from the outer end of the outline shape of the attachment section 43 in the radial direction R to an intermediate portion. Specifically, the wheel-side tab section 144 has a plurality of tiers of wheel-tab-side hook portions in the radial direction R, and the plurality of tiers of wheel-tab-side hook portions are provided in projecting shape on both sides in the circumferential direction C. Between the plurality of tiers of blade-tab-side hook portions, a plurality of tiers of wheel-tab-side neck portions are formed to be recessed in the circumferential direction C relative to the wheel-tab-side hook portions.

For example, the wheel-side tab section 144 has first to fourth wheel-tab-side hook portions 144*a*1, 144*a*2, 144*a*3, and 144*a*4 in this order toward the radially inward side Ri. The wheel-side tab section 144 has first to third wheel-tab-side neck portions 144*b*1, 144*b*2, and 144*b*3 in this order toward the radially inward side Ri corresponding to the first to fourth wheel-tab-side hook portions 144*a*1, 144*a*2, 144*a*3, and 144*a*4. Similarly to the peaks 43*ap*1, 43*ap*2, 43*ap*3, and 43*ap*4 on both sides of the plurality of tiers of attachment-section-side hook portions 43*a*1, 43*a*2, 43*a*3 and 43*a*4, the plurality of tiers of wheel-tab-side hook portions 144*a*1, 144*a*2, 144*a*3, and 144*a*4 are formed such that, when the wheel-side tab section 144 is seen in the axial direction A, of the distance between the circumferential positions of a pair of peaks 144*ap*1, 144*ap*2, 144*ap*3, and 144*ap*4 on both sides of each tier is gradually longer in the order of the first wheel-tab-side hook portions 144*a*1, the second wheel-tab-side hook portions 144*a*2, the third wheel-tab-side hook portions 144*a*3, and the fourth wheel-tab-side hook portions 144*a*4. That is, the outline shape of the wheel-side tab section 144 when seen in the axial direction A is formed such that the outline shape almost matches a particular shape Sc that is part of the outline shape of the attachment section 43 when seen in the axial direction A and that includes a range from the outer end (tip) of the outline shape of the attachment section 43 in the radial direction R, toward the radially inward side Ri, to the fourth attachment-section-side hook portions 43*a*4.

In the turbine wheel 140 of the comparative example having the configuration mentioned above, blade root sections 54 or blade-side tab sections 57 of turbine rotor blades 50 may contact any one or more of projecting first to fourth wheel-tab-side hook portions 144*a*1, 144*a*2, 144*a*3, and 144*a*4 of wheel-side tab sections 144 of the turbine wheel 140 in some cases when the turbine rotor blades 50 are assembled onto or disassembled from the turbine wheel 140. This may cause a residual tensile stress at a base portion (an end portion on the radially outward side Ro) of a wheel-side tab section 144. Accordingly, there is a concern over occurrences of cracks in the turbine wheel 140 resulting from the residual tensile stress caused in the wheel-side tab section 144 when a Ni based alloy is used as a base material of the turbine wheel 140 with the structure of the comparative example.

In addition, the strengths of turbine wheels made with a Ni based alloy are increased generally by performing shot peening over the entire surfaces of the turbine wheels to thereby generate compressive residual stresses on the turbine wheels. Since wheel-side tab sections 144 facing the side surfaces of attachment sections 43 have outline shapes approximately identical to those of the attachment sections 43 in the turbine wheel 140 of the comparative example having the configuration mentioned above, most portions of the side surfaces of the attachment sections 43 are hidden by the wheel-side tab sections 144 when shot peening is performed. Accordingly, it is difficult to sufficiently perform shot peening on the side surfaces of the attachment sections 43 facing the wheel-side tab sections 144, and there is a concern that the strengths of the turbine wheels 140 cannot be enhanced sufficiently.

Furthermore, when shot peening is performed, it is necessary to prevent occurrences of peeling and burrs at corner portions of the attachment sections 43 and the wheel-side tab sections 144. In view of this, the corner portions of the attachment sections 43 and the wheel-side tab sections 144 are rounded (corner rounding) in advance. However, since the outline shapes of the wheel-side tab sections 144 of the comparative example are recessed and projecting shapes that are almost identical to the outline shapes of the attachment sections 43, the shapes of the corner portions of the wheel-side tab sections 144 are complicated, and it is difficult to improve the working efficiency of the corner rounding.

Next, the shapes of wheel-side tab sections in the turbine wheel according to the first embodiment of the present invention are explained. As illustrated in FIGS. 3 and 7, the wheel-side tab sections 44 of the turbine wheel 40 of the present embodiment are formed such that the bottom surfaces 46*a* of the second grooves 46 are continuous with the bottom surfaces 58*a* of the first grooves 58 of the turbine rotor blades 50 that are adjacent, on both sides in the circumferential direction, to the bottom surfaces 46*a* of the second grooves 46. That is, the wire groove 63 is formed such that its bottom surface 63*a* is continuously annular (n.b. except for gaps for fitting). In this configuration, due to the action of the centrifugal force when the turbine rotor 30 (see FIG. 2) rotates at high speed, the entire annular fixation wire 61 is almost evenly pressed against the annular bottom surface 63*a* of the wire groove 63. Accordingly, roughly even stress is generated over the entire circumference of the fixation wire 61.

In contrast, if gaps larger than gaps for fitting are formed between bottom surfaces of second grooves and bottom surfaces of first grooves of turbine rotor blades 50 that are adjacent, on both sides in the circumferential direction, to the bottom surfaces of the second grooves, that is, if the bottom surfaces of the second grooves and the bottom surfaces of the first grooves are discontinuous, the fixation wire 61 alternately has supported portions that are pressed against the bottom surfaces of the first grooves or the bottom surfaces of the second grooves and unsupported portions that are positioned in the gaps between the second grooves 46 and the first grooves 58 at the rotation of the turbine rotor 30. In this case, there is a fear that excessive stresses occur locally on the fixation wire 61.

In addition, the outline shape of the wheel-side tab section 44 of the present embodiment when seen in the axial direction A is formed such that the outline shape almost matches a shape in which a portion of a particular shape is replaced with straight portions 44*c* along predetermined straight lines Lc1. The particular shape is part of the outline shape of the attachment section 43 when seen in the axial direction A, and includes an range from a radially outer end, toward the radially inward side Ri, to at least a attachment-section-side hook portion 43*a* adjacent, on the radially inward side Ri, to the bottom surface 46*a* of the second groove 46. The replaced portion of the particular shape is on the radially inward side Ri of the bottom surface 46*a* of the second groove 46 and is on an outer side, in the circumferential direction C, of the predetermined straight lines Lc1. The predetermined straight line Lc1 passes through the central axis Ax (see FIG. 1) and a point within a range along the particular shape from an intersection with the bottom surface 46*a* of the second groove 46 (a circumferential end of the bottom surface 46*a*) to a peak of the attachment-section-side hook portion 43*a* that is adjacent, on the radially outward side Ro, to the bottom surface 46*a* of the second groove 46.

For example, as illustrated in FIG. 7, the outline shape of the wheel-side tab section 44 as seen in the axial direction A is a shape in which a portion of a particular shape S is replaced with straight portions 44*c* along predetermined straight lines Lc1. The particular shape S is part of the outline shape of the attachment section 43 when seen in the axial direction A, and includes an range from the radially outer end (tip), toward the radially inward side Ri, to the fourth attachment-section-side hook portions 43*a*4. That is, The particular shape S is a shape identical to the outline shape of the wheel-side tab section 144 of the turbine wheel 140 of the comparative example when seen in the axial direction A (see FIG. 8). The replaced portion of the particular shape is positioned on the radially inward side Ri of the bottom surface 46*a* of the second groove 46 and is positioned on an outer side, in the circumferential direction C, of the predetermined straight lines Lc1.

The predetermined straight line Lc1 passes through the central axis Ax and a point within a range W1 along the particular shape S described above from an intersection E with the bottom surface 46*a* of the second groove 46 (the circumferential end of the bottom surface 46*a*) to a second peak 43*ap*2 of the second attachment-section-side hook portion 43*a*2 that is adjacent, on the radially outward side Ro, to the bottom surface 46*a* of the second groove 46. In other words, the predetermined straight line Lc1 is a line that has a starting point at the central axis Ax and is formed within the range between a straight line passing through the intersection E (the circumferential end of the bottom surface 46*a*) of the particular shape S with the bottom surface 46*a* of the second groove 46 and a straight line passing through the second peak 43*ap*2 of the second attachment-section-side hook portion 43*a*2 on the particular shape S. If the predetermined straight line Lc1 is positioned at the circumferentially innermost position, the predetermined straight line Lc1 coincides with a straight line Li1 passing through the central axis Ax and the intersection E with the bottom surface 46*a* of the second groove 46. On the other hand, if the predetermined straight line Lc1 is positioned at the circumferentially outermost position, the predetermined straight line Lc1 coincides with a straight line Lol passing through the central axis Ax and the second peak 43*ap*2 of the second attachment-section-side hook portion 43*a*2.

That is, a portion, on the radially outward side Ro of the bottom surface 46*a* of the second groove 46, of the outline shape of the wheel-side tab section 44 when seen in the axial direction A has a serrated shape similar to the shape of the attachment section 43. On the other hand, the portion, on the radially inward side Ri of the bottom surface 46*a* of the second groove 46, of the outline shape of the wheel-side tab section 44 has straight portions 44*c* along the predetermined straight lines Lc1 unlike the attachment section 43.

Specifically, the outline shape of the wheel-side tab section 44 as seen in the axial direction A has first to second wheel-tab-side hook portions 44*a*1 and 44*a*2 having shapes identical to the outline shape of the first to second attachment-section-side hook portions 43*a*1 and 43*a*2 of the attachment section 43 in this order toward the radially inward side Ri (in an illustrated example, the first wheel-tab-side hook portion 44*a*1 has a shape cut in such a way that it is inclined with respect to a plane orthogonal to the axial direction A). The wheel-side tab section 44 has first to second wheel-tab-side neck portions 44*b*1 and 44*b*2 with shapes identical to the outline shape of the first to second attachment-section-side neck portions 43*b*1 and 43*b*2 of the attachment section 43 in this order toward the radially inward side Ri corresponding to the first to second wheel-tab-side hook portions 44*a*1 and 44*a*2. The straight portions 44*c* are portions on the radially inward side Ri of the second wheel-tab-side neck portion 44*b*2, and are located in radial positions corresponding to the third to fourth attachment-section-side hook portions 43*a*3 and 43*a*4, and the third attachment-section-side neck portion 43*b*3.

The wheel-side tab section 44 of the present embodiment can be formed by machining as below. Removal processing such as cutting along the predetermined straight lines Lc1 from an inner peripheral side to the outer peripheral side is performed on a portion (portion with the particular shape S) which extends in the axial direction from a predetermined area of the attachment section 43 in a base material (work piece) of the turbine wheel 40 on which a plurality of slots 42 is formed. In this case, a final position on the radially outward side Ro of the removal processing is a surface of a hook portion adjacent, on the radially inward side Ri, to the bottom surface 46*a* of the second groove 46, and hook portions on the radially outward side Ro from the bottom surface 46*a* of the second groove 46 are not removed. Note that the predetermined straight lines Lc1 specify the processing lines for the removal processing on an circumferentially outer side from the circumferential ends E of the bottom surface 46*a* of the second groove 46 (except for portions on the radially outward side Ro from the bottom surface 46*a* of the second groove 46). A removal area from the particular shape S is set such that the bottom surface 46*a* of the second groove 46 is not removed at all and the entire bottom surface 46*a* is left.

Accordingly, unlike wheel-side tab sections 144 of the turbine wheel 140 of the comparative example (see FIG. 8), the wheel-side tab section 44 has a configuration not having third to fourth hook portions and a third neck portion. That is, in the wheel-side tab section 44 of the present embodiment, portions on the circumferentially outer side from the predetermined straight lines Lc1 are cut in comparison with that in FIG. 8. Note that if the predetermined straight lines Lc1 are the straight lines Li1 passing through the circumferential ends E of the bottom surface 46*a* of the second groove 46, the wheel-side tab section 44 has a configuration not having the second wheel-tab-side neck portion 44*b*2 also.

As mentioned above, in the turbine wheel according to the first embodiment of the present invention, each of the plurality of wheel-side tab sections 44 is formed such that the bottom surface 46*a* of the second groove 46 is continuous with the bottom surfaces 58*a* of the first grooves 58 that are adjacent, on both sides in the circumferential direction, to the bottom surface 46*a* of the second groove 46. That is, the predetermined straight lines Lc1 is positioned on the circumferentially outer side from the circumferential ends E of the bottom surface 46*a* of the second groove 46, thereby allowing the entire circumferential area on the bottom surface 46*a* of the second groove 46 to be left when part of the wheel-side tab sections 44 is cut. This allows the bottom surface 46*a* to be continuous with the turbine rotor blades 50 adjacent in the circumferential direction to form the wire groove 63. According to this configuration, due to the action of the centrifugal force generated at the time of the rotation of the turbine rotor 30, the annular fixation wire 61 is pressed almost uniformly against the continuous bottom surfaces 58*a* and 46*a* of the first grooves 58 and the second grooves 46. Accordingly, it is possible to prevent local occurrences of excessive stresses on the fixation wire 61 at the time of the rotation of the turbine rotor 30.

Additionally, in the present embodiment, the outline shape of the wheel-side tab section 44 when seen in the axial direction A is formed such that the outline shape almost matches a shape in which a portion of the particular shape S is replaced with the straight portions 44*c* along the predetermined straight lines Lc1. The particular shape S is part of the outline shape of the attachment section 43 when seen in the axial direction A, and includes an range from the radially outer end, toward the radially inward side Ri, to at least attachment-section-side hook portions 43*a* adjacent, on the radially inward side Ri, to the bottom surface 46*a* of the second groove 46. The replaced portion of the particular shape S is on the radially inward side Ri of the bottom surface 46*a* of the second groove 46 and is on the outer side, in the circumferential direction C, of the predetermined straight lines Lc1. The predetermined straight line Lc1 passes through the central axis Ax and a point in a range along the particular shape S from the intersection E with the bottom surface 46*a* of the second groove 46 to the peak of the attachment-section-side portion 43*a* adjacent, on the radially outward side Ro, to the bottom surface 46*a* of the second groove 46.

According to this configuration, in comparison with the wheel-side tab section 144 of the turbine wheel 140 of the comparative example that are formed such that the outline shape of the wheel-side tab section 144 when seen in the axial direction A almost matches the particular shape Sc that is part of the outline shape of the attachment section 43 when seen in the axial direction A and that includes a range from the outer end of the outline shape in the radial direction R, toward the radially inward side Ri, to the fourth attachment-section-side hook portions 43*a*4, the wheel-side tab section 44 do not include hook portions in a projecting shape at positions on the radially inward side Ri of the bottom surface 46*a* of the second groove 46. In other words, side surfaces on both sides in the circumferential direction of the wheel-side tab section 44 of the present embodiment are each composed of a flat portion formed by the straight portion 44*c* and a recessed portion formed by the second wheel-tab-side neck portion 44*b*2. That is, there are fewer projecting portions of the wheel-side tab section 44 that may get caught by the blade root sections 54 or the blade-side tab sections 57 of the turbine rotor blades 50 when the turbine rotor blades 50 are assembled onto or disassembled from the turbine wheel 40. Accordingly, it is possible to suppress occurrences of residual tensile stresses due to contacts between the wheel-side tab sections 44 and blade root sections 54 or blade-side tab sections 57 of turbine rotor blades 50; as a result, occurrences of cracks in the turbine wheel 40 resulting from the residual tensile stresses is suppressed.

Furthermore, according to this configuration, in comparison with the wheel-side tab sections 144 of the turbine wheel 140 of the comparative example, portions to be hidden that are generated on the side surfaces of the attachment sections 43 facing the wheel-side tab sections 44 when shot peening is performed are made small in size. Accordingly, areas where sufficient shot peening can be performed increase as compared with the configuration of the turbine wheel 140 of the comparative example, and thus it is possible to improve the strengths of attachment sections 43.

In addition, according to this configuration, the wheel-side tab section 44 has the outline shape of fewer recessed and projecting portions than the wheel-side tab section 144 of the turbine wheel 140 of the comparative example, and has more straight portions in the outline shape. Accordingly, the shapes of corner portions of the wheel-side tab section 44 are more simplified than those of the wheel-side tab section 144 of the turbine wheel 140 of the comparative example, and thus the working efficiency of the corner rounding of the wheel-side tab sections 44 improves.

In addition, according to this configuration, the engagement structures of the wheel-side tab sections 44 in relation to the blade-side tab sections 57 of turbine rotor blades 50 are kept at portions on the radially outward side Ro of the bottom surfaces 46*a* of the second grooves 46, and missing portions of the engagement structures are limited on the radially inward side Ri of the bottom surfaces 46*a* of the second grooves 46. Accordingly, gaps are generated at limited positions in engagement portions of the wheel-side tab sections 44 and the blade-side tab sections 57 when the turbine rotor blades 50 are assembled onto the turbine wheel 40, and thus this is preferable in terms of appearance (see FIG. 3).

Second Embodiment

Figure 9:
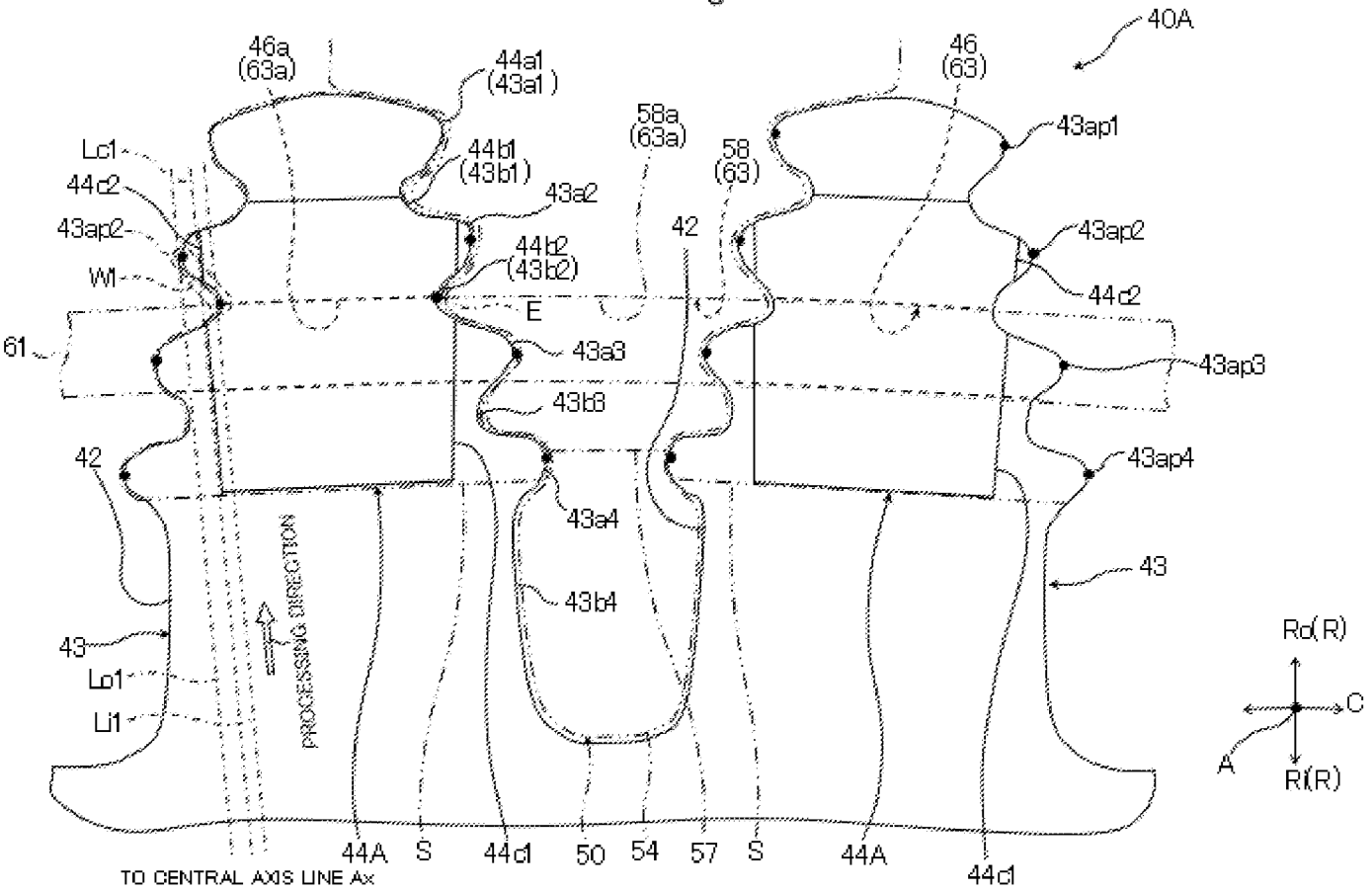
FIG. 9 is an explanatory diagram illustrating the outline shapes of attachment sections and wheel-side tab sections of a turbine wheel in a second embodiment of the present invention when seen in the axial direction.

Next, a turbine wheel according to a second embodiment of the present invention is explained by using FIG. 9. FIG. 9 is an explanatory diagram illustrating the outline shapes of wheel-side tab sections of the turbine wheel in the second embodiment of the present invention when seen in the axial direction. Note that portions in FIG. 9 that are given the same reference characters as those illustrated in FIG. 1 to FIG. 8 are similar portions, and thus detailed explanations thereof are omitted.

A difference of the turbine wheel according to the second embodiment of the present invention illustrated in FIG. 9 from the first embodiment lies in the outline shapes of wheel-side tab sections 44A. In the turbine wheel 40 of the first embodiment, the outline shape of the wheel-side tab section 44 when seen in the axial direction A has straight portions 44*c* along the predetermined straight lines Lc1 only in a portion on the radially inward side Ri of the bottom surface 46*a* of the second groove 46 (see FIG. 7). In contrast, in a turbine wheel 40A of the second embodiment, the outline shape of the wheel-side tab section 44A when seen in the axial direction A has straight portions 44*c*1 and 44*c*2 along the predetermined straight lines Lc1 in both a portion on the radially outward side Ro of a bottom surface 46*a* of a second groove 46 and a portion on the radially inward side Ri of the bottom surface 46*a* of the second groove 46.

Specifically, the outline shape of the wheel-side tab section 44A of the present embodiment when seen in the axial direction A is formed such that the outline shape matches a shape in which one portion of the particular shape S is replaced with first straight portions 44*c*1 along the predetermined straight lines Lc1 and another portion of the particular shape S is further replaced with second straight portions 44*c*2 along the predetermined straight lines Lc1. The particular shape S is part of the outline shape of the attachment section 43 when seen in the axial direction A, and includes an range from the radially outer end, toward the radially inward side Ri, to the fourth attachment-section-side hook portions 43*a*4 (the outline shape of the wheel-side tab section 144 of the turbine wheel 140 of the comparative example (see FIG. 8) when seen in the axial direction A). The portion of the particular shape S to be replaced with the first straight portions 44*c*1 is positioned on the radially inward side Ri of the bottom surface 46*a* of the second groove 46 and is positioned on the outer side, in the circumferential direction C, of the predetermined straight lines Lc1. The portion of the particular shape S to be replaced with the second straight portions 44*c*2 is positioned on the radially outward side Ro of the bottom surface 46*a* of the second groove 46 and is positioned on the outer side, in the circumferential direction C, of the predetermined straight lines Lc1. Note that the predetermined straight lines Lc1 are straight lines having a definition identical to the definition in the first embodiment.

In other words, the outline shape of the wheel-side tab section 44A when seen in the axial direction A has first wheel-tab-side hook portions 44*a*1 having a shape identical to the outline shape of the first attachment-section-side hook portions 43*a*1 of the attachment section 43. The wheel-side tab section 44A has first to second wheel-tab-side neck portions 44*b*1 and 44*b*2 with shapes identical to the outline shapes of the first to second attachment-section-side neck portions 43*b*1 and 43*b*2 of the attachment section 43 in this order toward the radially inward side Ri corresponding to the first wheel-tab-side hook portions 44*a*1. The first straight portions 44*c*1 are equivalent to straight portions 44*c* in the first embodiment, and are portions on the radially inward side Ri of the second wheel-tab-side neck portions 44*b*2. On the other hand, the second straight portions 44*c*2 are positioned between the first wheel-tab-side neck portions 44*b*1 and the second wheel-tab-side neck portions 44*b*2, and are located in radial positions corresponding to the second attachment-section-side hook portions 43*a*2.

Accordingly, unlike the wheel-side tab sections 144 of the turbine wheel 140 of the comparative example, the wheel-side tab section 44A has a configuration not having second to fourth hook portions and a third neck portion. Note that if the predetermined straight lines Lc1 are the straight lines Li1 passing through the circumferential ends E of the bottom surface 46*a* of the second groove 46, the wheel-side tab section 44A has a configuration not having the second wheel-tab-side neck portions 44*b*2 also.

According to the turbine wheel of the second embodiment of the present invention mentioned above, advantages similar to those in the first embodiment mentioned before can be attained. That is, it is possible to prevent local occurrences of excessive stresses on the fixation wire 61 at the time of the rotation of the turbine rotor 30. In addition, it is possible to suppress occurrences of residual tensile stresses due to contact between wheel-side tab sections 44A and blade root sections 54 or blade-side tab sections 57 of turbine rotor blades 50; as a result, occurrences of cracks in the turbine wheel 40A resulting from the residual tensile stresses can be suppressed. Furthermore, areas where sufficient shot peening can be performed increase as compared with the configuration of the turbine wheel 140 of the comparative example, and thus it is possible to improve the strengths of the attachment sections 43. Additionally, the shapes of corner portions of the wheel-side tab sections 44A are more simplified than those of the wheel-side tab sections 144 of the turbine wheel 140 of the comparative example, and thus the working efficiency of the corner rounding of the wheel-side tab sections 44A improves.

In addition, in the present embodiment, the outline shape of the wheel-side tab section 44A when seen in the axial direction A is formed such that the outline shape matches a shape in which another portion of the particular shape S (the outline shape of the wheel-side tab section 144 of the turbine wheel 140 of the comparative example (see FIG. 8) when seen in the axial direction A) is further replaced with the straight portions 44*c*2 along the predetermined straight lines Lc1. The portion of the particular shape S to be replaced with the straight portions 44*c*2 is on the radially outward side Ro of the bottom surface 46*a* of the second groove 46 and is on the outer side, in the circumferential direction C, of the predetermined straight lines Lc1.

According to this configuration, the outline shape of the wheel-side tab section 44A when seen in the axial direction A is a shape in which, over the entire range in the radial direction R of the particular shape S, a portion positioned on the outer side of the predetermined straight lines Lc1 in the circumferential direction C is replaced with the straight portions 44*c*1 and 44*c*2 along the predetermined straight lines Lc1. Because of this, the wheel-side tab section 44A can be shaped by removal processing of portions which extend in the axial direction from a predetermined area of the attachment section 43 made from a base material (work piece) of the turbine wheel 40A having a plurality of slots 42 formed thereon, for example, by cutting straight across the axially extending portion along the predetermined straight lines Lc1 from an inner peripheral side to the outer peripheral side. Accordingly, as compared to the first embodiment in which the removal processing of the base material (work piece) of the turbine wheel 40 is required to be stopped at an intermediate portion in the radial direction when a wheel-side tab section 44 is processed, the wheel-side tab section 44A can be processed easily. Note that the predetermined straight lines Lc1 specify the processing lines of the wheel-side tab section 44A.

Third Embodiment

Figure 10:
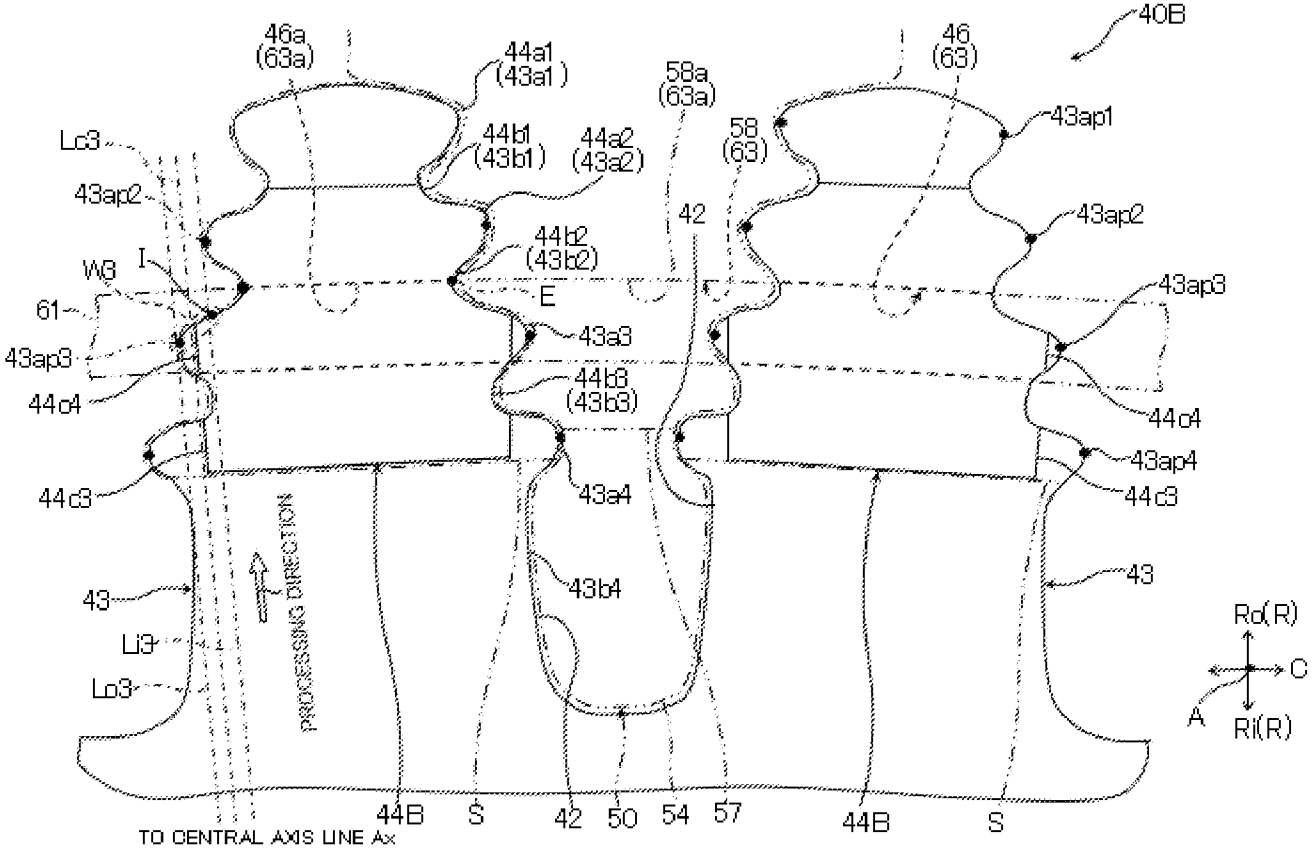
FIG. 10 is an explanatory diagram illustrating the outline shapes of attachment sections and wheel-side tab sections of a turbine wheel in a third embodiment of the present invention when seen in the axial direction.

Next, a turbine wheel according to a third embodiment of the present invention is explained by using FIG. 10. FIG. 10 is an explanatory diagram illustrating outline shapes of wheel-side tab sections of the turbine wheel in the third embodiment of the present invention when seen in the axial direction. Note that portions in FIG. 10 that are given the same reference characters as those illustrated in FIG. 1 to FIG. 9 are similar portions, and thus detailed explanations thereof are omitted.

A difference of the turbine wheel according to the third embodiment of the present invention illustrated in FIG. 10 from the second embodiment lies in outline shapes of wheel-side tab sections 44B. In the turbine wheel 40A of the second embodiment, the outline shape of the wheel-side tab section 44A when seen in the axial direction A has straight portions 44*c*1 and 44*c*2 along the predetermined straight lines Lc1 (see FIG. 9). In contrast, in a turbine wheel 40B of the third embodiment, the outline shape of the wheel-side tab section 44B when seen in the axial direction A has straight portions along another predetermined straight lines Lc3 different from the straight lines Lc1.

Specifically, the outline shape of the wheel-side tab section 44B of the present embodiment when seen in the axial direction A is formed such that the outline shape almost matches a shape in which a portion of the particular shape S is replaced with straight portions 44*c*3 and 44*c*4 along the predetermined straight lines Lc3. The particular shape S is part of the outline shape of the attachment section 43 when seen in the axial direction A, and includes the range from the radially outer end, toward the radially inward side Ri, to the fourth attachment-section-side hook portion 43*a* (the outline shape of the wheel-side tab section 144 of the turbine wheel 140 of the comparative example (see FIG. 8) when seen in the axial direction A).

The predetermined straight line Lc3 passes through the central axis Ax and a point within a range W3 along the particular shape S from an intersection I of a straight line Li3 and a third attachment-section-side hook portion 43*a*3 that is adjacent, on the radially inward side Ri, to the bottom surface 46*a* of the second groove 46 to a peak 43*ap*3 of the third attachment-section-side hook portion 43*a*3. The straight line Li3 passes through the central axis Ax (see FIG. 1) and a peak 43*ap*2 of a second attachment-section-side hook portion 43*a*2 adjacent, on the radially outward side Ro, to the bottom surface 46*a* of the second groove 46. In other words, the predetermined straight line Lc3 is a line that has a starting point at the central axis Ax and is formed in a range between a straight line passing through the peak 43*ap*2, on the particular shape S, of the second stage attachment-section-side hook portion 43*a*2 adjacent, on the radially outward side Ro, to the bottom surface 46*a* of the second groove 46 and a straight line passing through the peak 43*ap*3, on the particular shape S, of the third attachment-section-side hook portion 43*a* adjacent, on the radially inward side Ri, to the bottom surface 46*a* of the second groove 46. If the predetermined straight line Lc3 is positioned at the circumferentially innermost position, the predetermined straight line Lc3 coincides with the straight line Li3 passing through the central axis Ax and the second peak 43*ap*2 of the second attachment-section-side hook portion 43*a*2. On the other hand, if the predetermined straight line Lc3 is positioned at the circumferentially outermost position, the predetermined straight line Lc3 coincides with a straight line Lo3 passing through the central axis Ax and the third peak 43*ap*3 of the third attachment-section-side hook portion 43*a*3.

For example, the outline shape of the wheel-side tab section 44B as seen in the axial direction A has first to second wheel-tab-side hook portions 44*a*1 and 44*a*2 having shapes identical to the outline shapes of the first to second attachment-section-side hook portions 43*a*1 and 43*a*2 of the attachment section 43 in this order toward the radially inward side Ri. The wheel-side tab section 44B has first to second wheel-tab-side neck portions 44*b*1 and 44*b*2 having shapes identical to the outline shapes of the first to second attachment-section-side neck portions 43*b*1 and 43*b*2 of the attachment section 43 in this order toward the radially inward side Ri corresponding to the first to second wheel-tab-side hook portions 44*a*1 and 44*a*2, and has a third wheel-tab-side neck portion 44*b*3. Further, the wheel-side tab section 44B has two divided straight portions along the predetermined straight line Lc3, which two divided straight portions are a first straight portion 44*c*3 and a second straight portion 44*c*4. The first straight portion 44*c*3 is a portion on the radially inward side Ri of the third wheel-tab-side neck portion 44*b*3, and is located in a radial position corresponding to the fourth attachment-section-side hook portion 43*a*4. The second straight portion 44*c*4 is positioned between the second wheel-tab-side neck portion 44*b*2 and the third wheel-tab-side neck portion 44*b*3, and is located in a radial position corresponding to the third attachment-section-side hook portion 43*a*3.

Accordingly, unlike the wheel-side tab sections 144 of the turbine wheel 140 of the comparative example, the wheel-side tab section 44B has a configuration not having third to fourth hook portions. Note that if the predetermined straight line Lc3 is the straight line Li3 passing through the second peak 43*ap*2 of the second attachment-section-side hook portion 43*a*2, the wheel-side tab section 44B has a configuration not having the third wheel-tab-side neck portion 44*b*3 also. On the other hand, if the predetermined straight line Lc3 is the straight line Lo3 passing through the third peak 43*ap*3 of the third attachment-section-side hook portion 43*a*3, the wheel-side tab section 44B has a configuration not having only the fourth hook portion.

According to the turbine wheel of the third embodiment of the present invention mentioned above, advantages similar to those in the second embodiment mentioned before can be attained. That is, it is possible to prevent local occurrences of excessive stresses on the fixation wire 61 at the time of the rotation of the turbine rotor 30. In addition, it is possible to suppress occurrences of residual tensile stresses due to contact between the wheel-side tab sections 44B and the blade root sections 54 or the blade-side tab sections 57 of the turbine rotor blades 50; as a result, occurrences of cracks in the turbine wheel 40B resulting from the residual tensile stresses can be suppressed. Furthermore, areas where sufficient shot peening can be performed increase as compared with the configuration of the turbine wheel 140 of the comparative example, and thus it is possible to improve the strengths of the attachment sections 43. Additionally, the shapes of corner portions of the wheel-side tab sections 44B are more simplified than those of the wheel-side tab sections 144 of the turbine wheel 140 of the comparative example, and thus the working efficiency of the corner rounding of the wheel-side tab sections 44B improves.

In addition, in the present embodiment, the predetermined straight line Lc3 is a line that has a starting point at the central axis Ax and is formed in a range between a straight line passing through a peak, on the particular shape S, of the attachment-section-side hook portion 43*a* adjacent, on the radially outward side Ro, to the bottom surface 46*a* of the second groove 46 and a straight line passing through a peak, on the particular shape S, of the attachment-section-side hook portion adjacent, on the radially inward side Ri, to the bottom surface of the second groove 46. According to this configuration, the outline shape of the wheel-side tab section 44B when seen in the axial direction A is a shape in which, over the entire range in the radial direction R of the particular shape S, the portion positioned on the outer side of the predetermined straight line Lc3 in the circumferential direction C is replaced with straight portions 44*c*3 and 44*c*4 along the predetermined straight line Lc3. Accordingly, the wheel-side tab section 44B can be shaped by removal processing of portions that extend in the axial direction A from a predetermined area of the attachment section 43 made from a base material (work piece) of the turbine wheel 40B having a plurality of slots 42 formed thereon, for example, by cutting straight across the axially extending portions along the predetermined straight lines Lc3 from the inner peripheral side to the outer peripheral side. Accordingly, as compared to the first embodiment in which the removal processing of the base material (work piece) of the turbine wheel 40 is required to be stopped at an intermediate portion in the radial direction when a wheel-side tab section 44 is processed, the wheel-side tab section 44B can be processed easily. Note that the predetermined straight lines Lc3 specify the processing lines of the wheel-side tab section 44B.

Other Embodiments

Note that the present invention is not limited to the first to third embodiments mentioned above, and includes various modification examples. The embodiments described above are ones that are explained in detail for explaining the present invention in an easy-to-understand manner, and embodiments are not necessarily limited to ones including all the configurations that are explained. For example, some of the configurations of an embodiment can be replaced with configurations of another embodiment, and configurations of an embodiment can be added to the configurations of another embodiment. In addition, some of the configurations of each embodiment can additionally have other configurations, be removed or be replaced with other configurations.

For example, in the examples of the configurations illustrated in the first to third embodiments mentioned above, the attachment section 43 of the turbine wheels 40, 40A, and 40B has four tiers of hook portions 43*a*1, 43*a*2, 43*a*3, and 43*a*4, and four tiers of neck portions 43*b*1, 43*b*2, 43*b*3, and 43*b*4, and the blade root section 54 of the turbine rotor blade 50 has four tiers of hook portions 54*a*1, 54*a*2, 54*a*3, and 54*a*4, and four tiers of neck portions 54*b*1, 54*b*2, 54*b*3, and 54*b*4. However, attachment sections of a turbine wheel, and blade root sections of turbine rotor blades can each have a configuration having at least two tiers of hook portions.

In addition, in the examples illustrated in the embodiments mentioned above, the wheel-side tab sections 44, 44A, and 44B are formed such that the radial position of the bottom surface 46*a* of the second groove 46 is positioned near the vertices of the second attachment-section-side neck portions 43*b*2 on the radially inward side Ri of the first peaks 43*ap*1 of the first attachment-section-side hook portions 43*a*1. However, the bottom surface 46*a* of the second groove 46 can also be formed at any position that is on the radially inward side Ri of the first peaks 43*ap*1 of the first attachment-section-side hook portions 43*a*1 positioned at the outermost position on the radially outward side Ro in a plurality of tiers of attachment-section-side hook portions, and that is on the radially outward side Ro of the fourth peaks 43*ap*4 of the fourth attachment-section-side hook portions 43*a*4 positioned at the innermost position on the radially inward side Ri.

In addition, in the examples explained in the embodiments mentioned above, the particular shape S for specifying the outline shape of the wheel-side tab section 44, 44A, or 44B of the turbine wheel 40, 40A, or 40B when seen in the axial direction A is part of the outline shape of the attachment section 43 as seen in the axial direction A, and includes a range from the outer end (tip) of the outline shape in the radial direction R, toward the radially inward side Ri, to the fourth attachment-section-side hook portions 43*a*4. However, the particular shape S can also be formed such that the particular shape S is part of the outline shape of the attachment section 43 when seen in the axial direction A, and includes a range from the outer end (tip) of the outline shape in the radial direction R, toward the radially inward side Ri, to the third attachment-section-side hook portions 43*a*3 adjacent, on the radially inward side Ri, to the bottom surface 46*a* of the second groove 46. In addition, if the bottom surface 46*a* of the second groove 46 is formed at the position mentioned above, the particular shape S can be formed such that the particular shape S is part of the outline shape of the attachment section 43 when seen in the axial direction A, and includes a range from the outer end (tip) of the outline shape in the radial direction R, toward the radially inward side Ri, to at least attachment-section-side hook portions 43*a* adjacent, on the radially inward side Ri, to the bottom surface 46*a* of the second groove 46.

Conclusion

In this manner, the first to third embodiments mentioned above, and other embodiments have at least features like the ones explained below. That is, the turbine wheels 40, 40A, and 40B include: the plurality of attachment sections 43 that are arranged at an outer peripheral portion at intervals in the circumferential direction and form the plurality of slots 42 into which the blade root sections 54 are inserted in the axial direction to engage with the plurality of slots 42; and the plurality of wheel-side tab sections 44, 44A, and 44B that are each provided on one side of the plurality of attachment sections 43 in the axial direction, and form second grooves 46 opened toward both sides in the circumferential direction and toward the radially inward side. Each of the plurality of attachment sections 43 has the plurality of tiers of attachment-section-side hook portions (wheel-side hook portions) 43*a* and the plurality of tiers of attachment-section-side neck portions (wheel-side neck portions) 43*b* on both sides of the attachment section 43 in the circumferential direction. The plurality of tiers of attachment-section-side hook portions (wheel-side hook portions) 43*a* and the plurality of tiers of attachment-section-side neck portions (wheel-side neck portions) 43*b* respectively engage with the blade-root-side neck portions (blade-side neck portions) 54*b* and the blade-root-side hook portions (blade-side hook portions) 54*a* of blade root section 54. The plurality of wheel-side tab sections 44, 44A, and 44B are formed such that, together with blade-side tab sections 57 of the plurality of turbine rotor blades 50, the plurality of wheel-side tab sections 44, 44A, and 44B form the wire groove 63 for retaining the annular fixation wire 61 that inhibits the plurality of turbine rotor blades 50 from moving along the slots 42. Each of the plurality of wheel-side tab sections 44, 44A, and 44B is formed such that the bottom surface 46*a* of the second groove 46 is continuous with the bottom surfaces 58*a* of the first grooves 58 that are adjacent on both sides in the circumferential direction, to the bottom surface 46*a* of the second groove 46. The outline shape of the wheel-side tab section 44, 44A, or 44B when seen in the axial direction A is formed such that the outline shape matches a shape in which a portion of the particular shape S is replaced with straight portions 44*c*, 44*c*1, 44*c*3 and 44*c*4 along the predetermined straight lines Lc1; Lc3. The particular shape S is part of the outline shape of the attachment section 43 when seen in the axial direction A, and includes an range from the radially outer end, toward the radially inward side Ri, to at least attachment-section-side portions (wheel-side hook portions) 43*a* adjacent, on the radially inward side Ri, to the bottom surface 46*a* of the second groove 46. The portion of the particular shape S is at least on the radially inward side Ri of the bottom surface 46*a* of the second groove 46 and is on the outer side, in the circumferential direction C, of the predetermined straight lines Lc1 or Lc3. Each predetermined straight line Lc1 or Lc3 passes through the central axis Ax and a point within the range W1 or W3 along the particular shape S from the intersection E with the bottom surface 46*a* of the second groove 46 to a peak of the attachment-section-side hook portion (wheel-side hook portion) 43*a* that is adjacent, on the radially inward side, to the bottom surface 46*a* of the second groove 46.

According to this configuration, the annular fixation wire 61 is pressed almost uniformly against continuous bottom surfaces 58*a* and 46*a* of the first grooves 58 and the second grooves due to the action of the centrifugal force generated at the time of the rotation of the turbine rotor 30. Accordingly, it is possible to prevent local occurrences of excessive stresses on the fixation wire 61. In addition, the outline shape of the wheel-side tab section 44, 44A, or 44B when seen in the axial direction A is a shape in which at least part of projecting sections are removed from the wheel-side tab section 144 of the turbine wheel 140 of the comparative example. Accordingly, it is possible to inhibit the wheel-side tab section 44, 44A, or 44B from getting caught by a blade root section 54 or a blade-side tab section 57 of a turbine rotor blade 50 when the turbine rotor blade 50 is assembled onto or disassembled from the turbine wheel 40, 40A or 40B. As a result, occurrences of residual tensile stresses on the turbine wheels 40, 40A, and 40B due to contact between turbine rotor blades 50 and the wheel-side tab sections 44, 44A, and 44B can be suppressed.

What is claimed is:

1. A turbine wheel that is rotatable around a central axis, and is connectable, at an outer peripheral portion, with a plurality of turbine rotor blades each including a blade root section and a blade-side tab section, the blade root section having a plurality of tiers of concave-convex blade-side neck portions and blade-side hook portions in a radial direction, the plurality of tiers of blade-side neck portions and blade-side hook portions being formed on both sides of the blade root section in a circumferential direction, the blade-side tab section being provided on one side of the blade root section in an axial direction and forming a first groove opened toward both sides in the circumferential direction and toward a radially inward side, the turbine wheel comprising:

a plurality of attachment sections that are arranged at the outer peripheral portion at intervals in the circumferential direction, and form a plurality of slots into which the blade root sections are inserted in the axial direction to engage with the plurality of slots; and a plurality of wheel-side tab sections provided on one side of the plurality of attachment sections in the axial direction, each of the plurality of wheel-side tab sections forming a second groove opened toward both sides in the circumferential direction and toward the radially inward side, wherein each of the plurality of attachment sections has a plurality of tiers of wheel-side hook portions and a plurality of tiers of wheel-side neck portions on both sides in the circumferential direction, the plurality of tiers of wheel-side hook portions and the plurality of tiers of wheel-side neck portions being formed to respectively engage with the blade-side neck portions and the blade-side hook portions of the blade root section, the plurality of wheel-side tab sections are formed such that, together with the blade-side tab sections of the plurality of turbine rotor blades, the plurality of wheel-side tab sections form a wire groove for retaining an annular fixation wire to inhibit the plurality of turbine rotor blades from moving along the slots, each of the plurality of wheel-side tab sections is formed such that a bottom surface of the second groove is continuous with bottom surfaces of first grooves that are adjacent on both sides in the circumferential direction, an outline shape of each wheel-side tab section when seen in the axial direction is formed such that the outline shape matches a shape in which a portion of a particular shape is replaced with straight portions along predetermined straight lines, the particular shape being part of an outline shape of each attachment section when seen in the axial direction, the particular shape including an range from a radially outer end, toward the radially inward side, to at least a wheel-side hook portion adjacent, on the radially inward side, to the bottom surface of the second groove, the portion being at least on the radially inward side of the bottom surface of the second groove and being on an outer side, in the circumferential direction, of the predetermined straight lines, and each of the predetermined straight lines passes through the central axis and a point in a range along the particular shape from an intersection with the bottom surface of the second groove to a peak of a wheel-side hook portion adjacent, on the radially inward side, to the bottom surface of the second groove.

2. The turbine wheel according to claim 1, wherein each predetermined straight line is a line that has a starting point at the central axis and is formed in a range between a straight line passing through the intersection of the particular shape with the bottom surface of the second groove and a straight line passing through a peak, on the particular shape, of wheel-side hook portion adjacent, on a radially outward side, to the bottom surface of the second groove.

3. The turbine wheel according to claim 2, wherein the outline shape of the wheel-side tab section when seen in the axial direction is formed such that the outline shape matches a shape in which another portion of the particular shape is further replaced with straight portions along the predetermined straight lines, the another portion being on the radially outward side of the bottom surface of the second groove and being on the outer side, in the circumferential direction, of the predetermined straight lines.

4. The turbine wheel according to claim 1, wherein each predetermined straight line is a line that has a starting point at the central axis and are formed in a range between a straight line passing through a peak, on the particular shape, of a wheel-side hook portion adjacent, on a radially outward side, to the bottom surface of the second groove and a straight line passing through the peak, on the particular shape, of the wheel-side hook portion adjacent, on the radially inward side, to the bottom surface of the second groove.

5. The turbine wheel according to claim 1, wherein each attachment section has first to fourth wheel-side hook portions, the second groove is formed such that the bottom surface is positioned on the radially inward side of peaks of the second wheel-side hook portions and is positioned on a radially outward side of peaks of the third wheel-side hook portions, the particular shape includes a range from the radially outer end of the outline shape to the fourth wheel-side hook portions, and each predetermined straight line passes through the central axis and a point in a range from the intersection of the particular shape with the bottom surface of the second groove to the peak of the third wheel-side hook portion.

6. The turbine wheel according to claim 5, wherein each predetermined straight line is a line that has a starting point at the central axis and is formed in a range between a straight line passing through the intersection of the particular shape with the bottom surface of the second groove and a straight line passing through the peak, on the particular shape, of the second wheel-side hook portion.

7. The turbine wheel according to claim 5, wherein each predetermined straight line is a line that has a starting point at the central axis and is formed in a range between a straight line passing through the peak, on the particular shape, of the second wheel-side hook portions and a straight line passing through the peak, on the particular shape, of the third wheel-side hook portion.

* * * * *